US012435570B2

(12) United States Patent
Sahli et al.

(10) Patent No.: US 12,435,570 B2
(45) Date of Patent: Oct. 7, 2025

(54) DIRECTIONAL DRILLING FRAMEWORK

(71) Applicant: Schlumberger Technology Corporation, Sugar Land, TX (US)

(72) Inventors: Hussein Sahli, Houston, TX (US); Samba Ba, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/451,288

(22) Filed: Aug. 17, 2023

(65) Prior Publication Data

US 2025/0059834 A1 Feb. 20, 2025

(51) Int. Cl.

| | |
|---|---|
| ***E21B 7/04*** | (2006.01) |
| ***E21B 44/00*** | (2006.01) |
| ***E21B 47/005*** | (2012.01) |

(52) U.S. Cl.

CPC ..... *E21B 7/04* (2013.01); *E21B 44/00* (2013.01); *E21B 47/005* (2020.05); *E21B 2200/20* (2020.05)

(58) Field of Classification Search

CPC ..... E21B 44/00; E21B 7/04; E21B 2200/20
See application file for complete search history.

(56) References Cited

U.S. PATENT DOCUMENTS

| | | | | |
|---|---|---|---|---|
| 6,438,495 | B1 | 8/2002 | Chau et al. | |
| 2007/0032958 | A1 | 2/2007 | Chen | |
| 2012/0018219 | A1* | 1/2012 | Runia | E21B 7/04 175/26 |
| 2018/0306944 | A1* | 10/2018 | Ledroz | E21B 47/0228 |
| 2019/0353023 | A1* | 11/2019 | Whitacre | E21B 47/024 |
| 2020/0080409 | A1* | 3/2020 | Haggerty | E21B 7/04 |
| 2020/0370409 | A1 | 11/2020 | Yu et al. | |
| 2021/0396127 | A1* | 12/2021 | Collins | G01V 20/00 |
| 2022/0170359 | A1* | 6/2022 | Boualleg | G06N 20/20 |
| 2023/0184078 | A1 | 6/2023 | Close et al. | |

FOREIGN PATENT DOCUMENTS

| | | | |
|---|---|---|---|
| WO | 2022073027 | A1 | 4/2022 |
| WO | 2022165495 | A1 | 8/2022 |

* cited by examiner

*Primary Examiner* — Tara Schimpf
*Assistant Examiner* — Ursula Lee Norris
(74) *Attorney, Agent, or Firm* — Jeffrey D. Frantz

(57) ABSTRACT

A system and method that may include receiving real-time downhole data from one or more sensors of a drillstring disposed in a borehole in a subsurface geologic region during a directional drilling operation. The system and method also include selecting a drillstring drilling mode from a plurality of drillstring drilling modes. The system and method may additionally include predicting, in real-time, characteristics of a hole bottom of the borehole using the drilling mode model and at least a portion of the real-time downhole data. The system and method may further include controlling the directional drilling operation using one or more of the characteristics.

20 Claims, 18 Drawing Sheets

DIRECTIONAL DRILLING FRAMEWORK

BACKGROUND

A reservoir may be a subsurface formation that may be characterized at least in part by its porosity and fluid permeability. As an example, a reservoir may be part of a basin such as a sedimentary basin. A basin may be a depression (e.g., caused by plate tectonic activity, subsidence, etc.) in which sediments accumulate. As an example, where hydrocarbon source rocks occur in combination with appropriate depth and duration of burial, a petroleum system may develop within a basin, which may form a reservoir that includes hydrocarbon fluids (e.g., oil, gas, etc.).

In oil and gas exploration, interpretation is a process that involves analysis of data to identify and locate various subsurface structures (e.g., horizons, faults, geobodies, etc.) in a geologic environment. Various types of structures (e.g., stratigraphic formations) may be indicative of hydrocarbon traps or flow channels, as may be associated with one or more reservoirs (e.g., fluid reservoirs). In the field of resource extraction, enhancements to interpretation may allow for construction of a more accurate model of a subsurface region, which, in turn, may improve characterization of the subsurface region for purposes of resource extraction. Characterization of one or more subsurface regions in a geologic environment may guide, for example, performance of one or more operations (e.g., field operations, etc.). As an example, a more accurate model of a subsurface region may make a drilling operation more accurate as to a borehole's trajectory where the borehole is to have a trajectory that penetrates a reservoir, etc., where fluid may be produced via the borehole (e.g., as a completed well, etc.). As an example, one or more workflows may be performed using one or more computational frameworks and/or one or more pieces of equipment that include features for one or more of planning, analysis, acquisition, model building, control, etc., for exploration, interpretation, drilling, fracturing, production, etc.

SUMMARY

A method may include receiving real-time downhole data from one or more sensors of a drillstring disposed in a borehole in a subsurface geologic region during a directional drilling operation where a drill bit of the drillstring breaks rock of the subsurface geologic region to lengthen the borehole. The method may also include selecting a drillstring drilling mode from a plurality of drillstring drilling modes. The drillstring drilling mode may include an associated drilling mode model for the directional drilling operation. The method may additionally include predicting, in real-time, characteristics of a hole bottom of the borehole using the drilling mode model and at least a portion of the real-time downhole data. The method may further include controlling the directional drilling operation using one or more of the characteristics. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The following detailed description refers to the accompanying drawings. Wherever convenient Features and advantages of the described implementations may be more readily understood by reference to the following description taken in conjunction with the accompanying drawings.

DETAILED DESCRIPTION

This description is not to be taken in a limiting sense, but rather is made merely for the purpose of describing the general principles of the implementations. The scope of the described implementations should be ascertained with reference to the issued claims.

Figure 1:
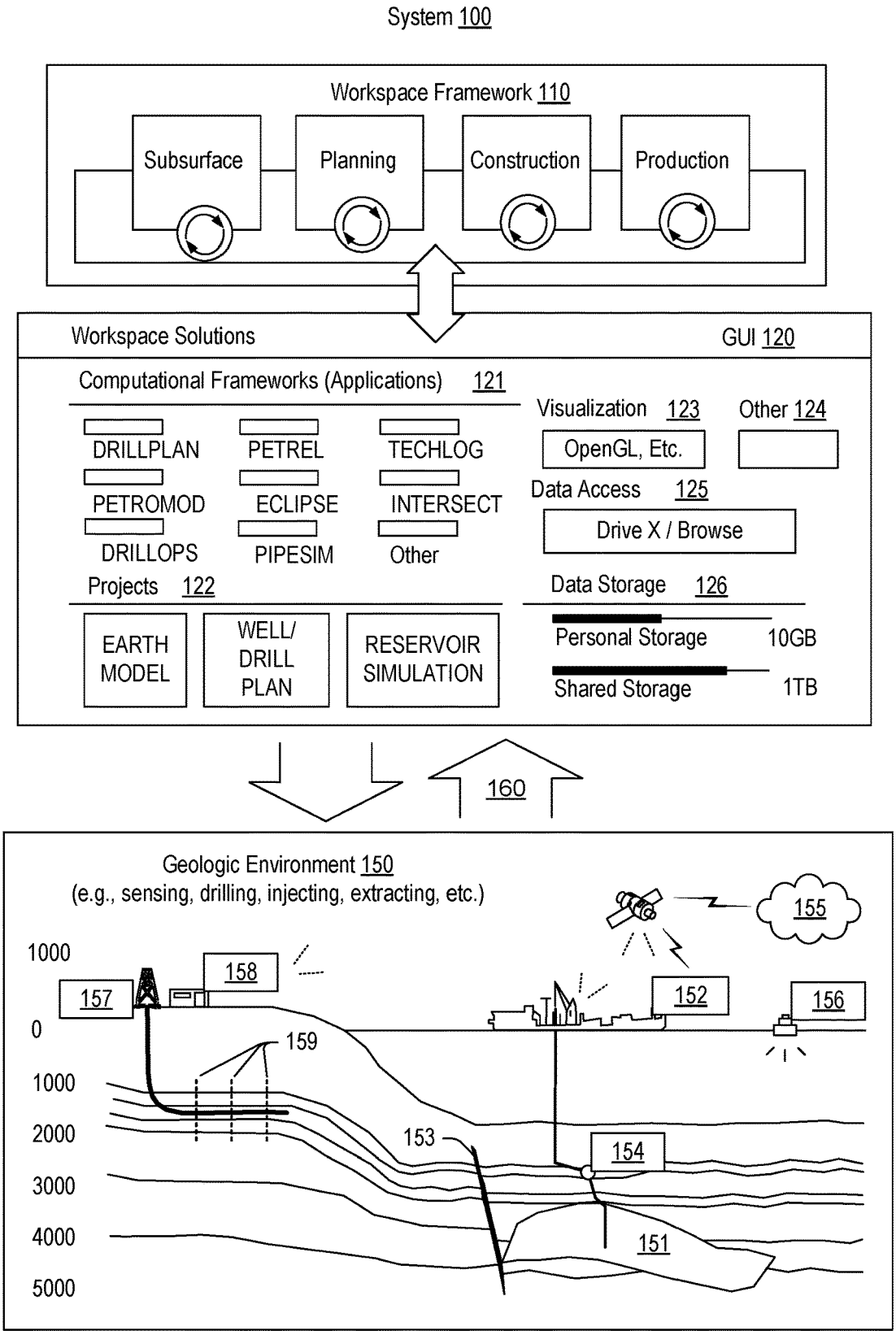
FIG. 1 shows an example of a system.

FIG. 1 shows an example of a system 100 that includes a workspace framework 110 that may provide for instantiation of, rendering of, interactions with, etc., a graphical user interface (GUI) 120. In the example of FIG. 1, the GUI 120 may include graphical controls for computational frameworks (e.g., applications, etc.) 121, projects 122, visualization features 123, one or more other features 124, data access 125, and data storage 126.

In the example of FIG. 1, the workspace framework 110 may be tailored to a particular geologic environment such as an example geologic environment 150. For example, the geologic environment 150 may include layers (e.g., stratification) that include a reservoir 151 and that may be intersected by a fault 153. As an example, the geologic environment 150 may be outfitted with a variety of sensors, detectors, actuators, etc. For example, equipment 152 may include communication circuitry that may be configured to receive and to transmit information with respect to one or more networks 155. Such information may include information associated with downhole equipment 154, which may be equipment to acquire information, to assist with resource recovery, etc. Other equipment 156 may be located remote from a wellsite and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or alternatively include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

In the example of FIG. 1, the GUI 120 shows some examples of computational frameworks, including the DRILLPLAN, DRILLOPS, PETREL, TECHLOG, PETROMOD, ECLIPSE, PIPESIM, and INTERSECT frameworks (SLB, Houston, Texas).

The DRILLPLAN framework provides for digital well construction planning and includes features for automation of repetitive tasks and validation workflows, enabling improved quality drilling programs (e.g., digital drilling plans, etc.) to be produced quickly with assured coherency.

The DRILLOPS framework may execute a digital drilling plan and ensures plan adherence, while delivering goal-based automation. The DRILLOPS framework may generate activity plans automatically individual operations, whether they are monitored and/or controlled on the rig or in town. Automation may utilize data analysis and learning systems to assist and optimize tasks, such as, for example, setting ROP to drilling a stand. A preset menu of automatable drilling tasks may be rendered, and, using data analysis and models, a plan may be executed in a manner to achieve a specified goal, where, for example, measurements may be utilized for calibration. The DRILLOPS framework provides flexibility to modify and replan activities dynamically, for example, based on a live appraisal of various factors (e.g., equipment, personnel, and supplies). Well construction activities (e.g., tripping, drilling, cementing, etc.) may be continually monitored and dynamically updated using feedback from operational activities. The DRILLOPS framework may provide for various levels of automation based on planning and/or re-planning (e.g., via the DRILLPLAN framework), feedback, etc.

The PETREL framework may be part of the DELFI environment for utilization in geosciences and geoengineering, for example, to analyze subsurface data from exploration to production of fluid from a reservoir. The DELFI cognitive exploration and production (E&P) environment (SLB, Houston, Texas), referred to herein as the DELFI environment or DELFI framework, is a secure, cognitive, cloud-based collaborative environment that integrates data and workflows with digital technologies, such as artificial intelligence and machine learning.

The PETREL framework provides components that allow for optimization of various exploration, development and production operations. The PETREL framework includes seismic to simulation software components that may output information for use in increasing reservoir performance, for example, by improving asset team productivity. Through use of such a framework, various professionals (e.g., geophysicists, geologists, and reservoir engineers) may develop collaborative workflows and integrate operations to streamline processes (e.g., with respect to one or more geologic environments, etc.). Such a framework may be considered an application (e.g., executable using one or more devices) and may be considered a data-driven application (e.g., where data is input for purposes of modeling, simulating, etc.).

The TECHLOG framework may handle and process field and laboratory data for a variety of geologic environments (e.g., deepwater exploration, shale, etc.). The TECHLOG framework may structure wellbore data for analyses, planning, etc.

The PETROMOD framework provides petroleum systems modeling capabilities that may combine one or more of seismic, well, and geological information to model the evolution of a sedimentary basin. The PETROMOD framework may predict if, and how, a reservoir has been charged with hydrocarbons, including the source and timing of hydrocarbon generation, migration routes, quantities, and hydrocarbon type in the subsurface or at surface conditions.

The ECLIPSE framework provides a reservoir simulator (e.g., as a computational framework) with numerical solutions for fast and accurate prediction of dynamic behavior for various types of reservoirs and development schemes.

The INTERSECT framework provides a high-resolution reservoir simulator for simulation of detailed geological features and quantification of uncertainties, for example, by creating accurate production scenarios and, with the integration of precise models of the surface facilities and field operations, the INTERSECT framework may produce reliable results, which may be continuously updated by real-time data exchanges (e.g., from one or more types of data acquisition equipment in the field that may acquire data during one or more types of field operations, etc.). The INTERSECT framework may provide completion configurations for complex wells where such configurations may be built in the field, may provide detailed enhanced-oil-recovery (EOR) formulations where such formulations may be implemented in the field, may analyze application of steam injection and other thermal EOR techniques for implementation in the field, advanced production controls in terms of reservoir coupling and flexible field management, and flexibility to script customized solutions for improved modeling and field management control. The INTERSECT framework, as with the other example frameworks, may be utilized as part of the DELFI environment, for example, for rapid simulation of multiple concurrent cases. For example, a workflow may utilize one or more of the DELFI environment on demand reservoir simulation features.

The aforementioned DELFI environment provides various features for workflows as to subsurface analysis, planning, construction and production, for example, as illustrated in the workspace framework 110. As shown in FIG. 1, outputs from the workspace framework 110 may be utilized for directing, controlling, etc., one or more processes in the geologic environment 150 and, feedback 160, may be received via one or more interfaces in one or more forms (e.g., acquired data as to operational conditions, equipment conditions, environment conditions, etc.).

As an example, a workflow may progress to a geology and geophysics ("G&G") service provider, which may generate a well trajectory, which may involve execution of one or more G&G frameworks (e.g., consider the PETREL framework, etc.).

In the example of FIG. 1, the visualization features 123 may be implemented via the workspace framework 110, for example, to perform tasks as associated with one or more of subsurface regions, planning operations, constructing wells and/or surface fluid networks, and producing from a reservoir.

As an example, visualization features may provide for visualization of various earth models, properties, etc., in one or more dimensions. As an example, visualization features may provide for rendering of information in multiple dimensions, which may optionally include multiple resolution rendering. In such an example, information being rendered may be associated with one or more frameworks and/or one or more data stores. As an example, visualization features may include one or more control features for control of equipment, which may include, for example, field equipment that may perform one or more field operations. As an example, a workflow may utilize one or more frameworks to generate information that may be utilized to control one or more types of field equipment (e.g., drilling equipment, wireline equipment, fracturing equipment, etc.).

As to a reservoir model that may be suitable for utilization by a simulator, consider acquisition of seismic data as acquired via reflection seismology, which finds use in geophysics, for example, to estimate properties of subsurface formations. As an example, reflection seismology may provide seismic data representing waves of elastic energy (e.g., as transmitted by P-waves and S-waves, in a frequency range of approximately 1 Hz to approximately 100 Hz). Seismic data may be processed and interpreted, for example, to understand better composition, fluid content, extent and geometry of subsurface rocks. Such interpretation results may be utilized to plan, simulate, perform, etc., one or more operations for production of fluid from a reservoir (e.g., reservoir rock, etc.).

As an example, a model may be a simulated version of a geologic environment. As an example, a simulator may include features for simulating physical phenomena in a geologic environment based at least in part on a model or models. A simulator, such as a reservoir simulator, may simulate fluid flow in a geologic environment based at least in part on a model that may be generated via a framework that receives seismic data. A simulator may be a computerized system (e.g., a computing system) that may execute instructions using one or more processors to solve a system of equations that describe physical phenomena subject to various constraints. In such an example, the system of equations may be spatially defined (e.g., numerically discretized) according to a spatial model that that includes layers of rock, geobodies, etc., that have corresponding positions that may be based on interpretation of seismic and/or other data. A spatial model may be a cell-based model where cells are defined by a grid (e.g., a mesh). A cell in a cell-based model may represent a physical area or volume in a geologic environment where the cell may be assigned physical properties (e.g., permeability, fluid properties, etc.) that may be germane to one or more physical phenomena (e.g., fluid volume, fluid flow, pressure, etc.). A reservoir simulation model may be a spatial model that may be cell-based.

While several simulators are illustrated in the example of FIG. 1, one or more other simulators may be utilized, additionally or alternatively. For example, consider the VISAGE geomechanics simulator (SLB, Houston Texas) or the PIPESIM network simulator (SLB, Houston Texas), etc. The VISAGE simulator includes finite element numerical solvers that may provide simulation results such as, for example, results as to compaction and subsidence of a geologic environment, well and completion integrity in a geologic environment, cap-rock and fault-seal integrity in a geologic environment, fracture behavior in a geologic environment, thermal recovery in a geologic environment, CO2 disposal, etc. The PIPESIM simulator includes solvers that may provide simulation results such as, for example, multiphase flow results (e.g., from a reservoir to a wellhead and beyond, etc.), flowline and surface facility performance, etc. The PIPESIM simulator may be integrated, for example, with the AVOCET production operations framework (SLB, Houston Texas). As an example, a reservoir or reservoirs may be simulated with respect to one or more enhanced recovery techniques (e.g., consider a thermal process such as steam-assisted gravity drainage (SAGD), etc.). As an example, the PIPESIM simulator may be an optimizer that may optimize one or more operational scenarios at least in part via simulation of physical phenomena. The MANGROVE simulator (SLB, Houston, Texas) provides for optimization of stimulation design (e.g., stimulation treatment operations such as hydraulic fracturing) in a reservoir-centric environment. The MANGROVE framework may combine scientific and experimental work to predict geomechanical propagation of hydraulic fractures, reactivation of natural fractures, etc., along with production forecasts within 3D reservoir models (e.g., production from a drainage area of a reservoir where fluid moves via one or more types of fractures to a well and/or from a well). The MANGROVE framework may provide results pertaining to heterogeneous interactions between hydraulic and natural fracture networks, which may assist with optimization of the number and location of fracture treatment stages (e.g., stimulation treatment(s)), for example, to increased perforation efficiency and recovery.

As an example, a tool may be positioned to acquire information in a portion of a borehole. Analysis of such information may reveal vugs, dissolution planes (e.g., dissolution along bedding planes), stress-related features, dip events, etc. As an example, a tool may acquire information that may help to characterize a fractured reservoir, optionally where fractures may be natural and/or artificial (e.g., hydraulic fractures). Such information may assist with completions, stimulation treatment, etc. As an example, information acquired by a tool may be analyzed using a framework such as the aforementioned TECHLOG framework.

As an example, a workflow may utilize one or more types of data for one or more processes (e.g., stratigraphic modeling, basin modeling, completion designs, drilling, production, injection, etc.). As an example, one or more tools may provide data that may be used in a workflow or workflows that may implement one or more frameworks (e.g., PETREL, TECHLOG, PETROMOD, ECLIPSE, etc.).

In the example of FIG. 1, drilling may be performed in the geologic environment 150, for example, to access the reservoir 151, which may be accessed from land or offshore. In FIG. 1, the downhole equipment 154 may be, for example, part of a bottom hole assembly (BHA). The BHA may be used to drill a well. The downhole equipment 154 may communicate information to equipment at the surface. The downhole equipment 154 may receive instructions and information from the equipment at the surface. During a well construction process, a variety of operations (such as cementing, wireline evaluation, testing, etc.) may be conducted. In such embodiments, data collected by tools and sensors and used for reasons such as reservoir characterization may be collected and transmitted.

A well may include a substantially horizontal portion (e.g., lateral portion) that may intersect with one or more fractures. For example, a well in a shale formation may pass through natural fractures, artificial fractures (e.g., hydraulic fractures), or a combination thereof. Such a well may be constructed using directional drilling techniques as described herein. However, these same techniques may be used in connection with other types of directional wells (such as slant wells, S-shaped wells, deep inclined wells, and others) and are not limited to horizontal wells.

Figure 2:
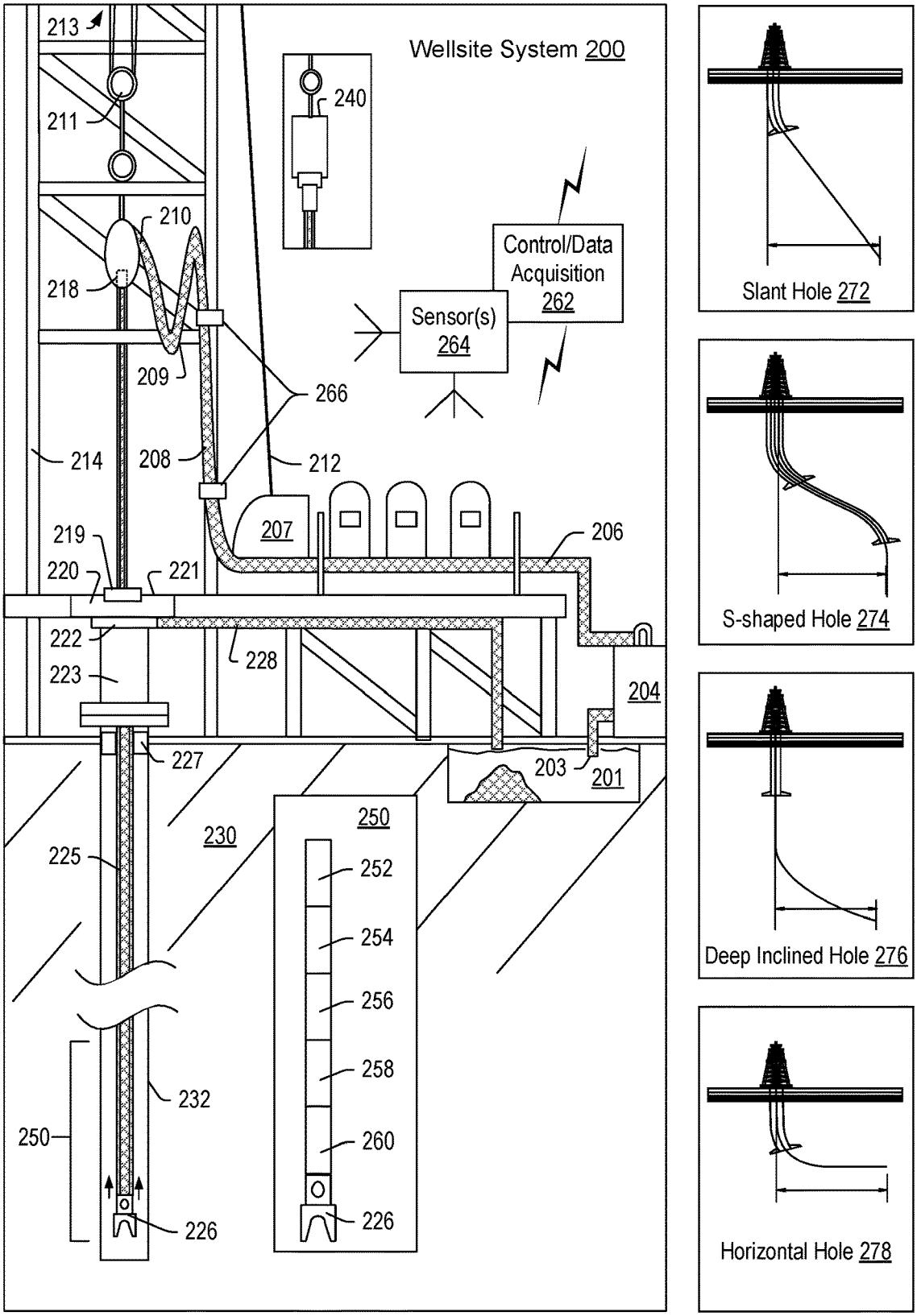
FIG. 2 shows an example of a system.

FIG. 2 shows an example of a wellsite system 200 (e.g., at a wellsite that may be onshore or offshore). As shown, the wellsite system 200 may include a mud tank 201 for holding mud and other material (e.g., where mud may be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212, a derrick 214, a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use one or more directional drilling techniques, equipment, etc.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 may provide for operation of the drillstring 225 and other operations. As shown, the wellsite system 200 includes the traveling block 211 and the derrick 214 positioned over the borehole 232. As mentioned, the wellsite system 200 may include the rotary table 220 where the drillstring 225 pass through an opening in the rotary table 220.

As shown in the example of FIG. 2, the wellsite system 200 may include the kelly 218 and associated components, etc., or a top drive 240 and associated components. As to a kelly example, the kelly 218 may be a square or hexagonal metal/alloy bar with a hole drilled therein that serves as a mud flow path. The kelly 218 may be used to transmit rotary motion from the rotary table 220 via the kelly drive bushing 219 to the drillstring 225, while allowing the drillstring 225 to be lowered or raised during rotation. The kelly 218 may pass through the kelly drive bushing 219, which may be driven by the rotary table 220. As an example, the rotary table 220 may include a master bushing that operatively couples to the kelly drive bushing 219 such that rotation of the rotary table 220 may turn the kelly drive bushing 219 and hence the kelly 218. The kelly drive bushing 219 may include an inside profile matching an outside profile (e.g., square, hexagonal, etc.) of the kelly 218; however, with slightly larger dimensions so that the kelly 218 may freely move up and down inside the kelly drive bushing 219.

As to a top drive example, the top drive 240 may provide functions performed by a kelly and a rotary table. The top drive 240 may turn the drillstring 225. As an example, the top drive 240 may include one or more motors (e.g., electric and/or hydraulic) connected with appropriate gearing to a short section of pipe called a quill, that in turn may be screwed into a saver sub or the drillstring 225 itself. The top drive 240 may be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 may hold mud, which may be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via the lines 206, 208 and 209 to a port of the kelly 218 or, for example, to a port of the top drive 240. The mud may then flow via a passage (e.g., or passages) in the drillstring 225 and out of ports located on the drill bit 226 (see, e.g., a directional arrow). As the mud exits the drillstring 225 via ports in the drill bit 226, it may then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drillstring 225 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drillstring 225 at a bottom of a wellbore, pumping of the mud commences to lubricate the drill bit 226 for purposes of drilling to enlarge the wellbore. As mentioned, the mud may be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud may cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes various modules 254, 256, and 258, which may be or include a logging-while-drilling (LWD) module (e.g., a LWD tool), a measurement-while-drilling (MWD) module (e.g., an MWD tool), and/or one or more other modules. As an example, a module 260 may be or include a rotary-steerable system (RSS) (e.g., an RSS or an RSS tool) and/or a motor (e.g., a mud motor, etc.). In various examples, a drillstring may include an RSS tool, a mud motor or an RSS tool and a mud motor. As shown, the assembly 250 includes the drill bit 226. Such components or modules may be referred to as tools where a drillstring may include a plurality of tools.

As to an RSS, it involves technology utilized for directional drilling. Directional drilling involves drilling into the Earth to form a deviated bore such that the trajectory of the bore is not vertical; rather, the trajectory deviates from vertical along one or more portions of the bore. As an example, consider a target that is located at a lateral distance from a surface location where a rig may be stationed. In such an example, drilling may commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; however, a mud motor may present some challenges depending on factors such as rate of penetration (ROP), transferring weight to a bit (e.g., weight on bit, WOB) due to friction, etc. A mud motor may be a positive displacement motor (PDM) that operates to drive a bit (e.g., during directional drilling, etc.). A PDM operates as drilling fluid is pumped through it where the PDM converts hydraulic power of the drilling fluid into mechanical power to cause the bit to rotate.

As an example, a mud motor (e.g., a PDM) may be operated in different modes, which may include a rotating mode and a sliding mode. A sliding mode involves drilling with a mud motor rotating the bit downhole without rotating the drillstring from the surface. Such an operation may be conducted when a BHA has been fitted with a bent sub or a bent housing mud motor, or both, for directional drilling. Sliding may be used in building and controlling or adjusting hole angle. In directional drilling, pointing of a bit may be accomplished through a bent sub, which may have a relatively small angle offset from the axis of a drillstring, and a measurement device to determine the direction of offset. Without turning the drillstring, the bit may be rotated with mud flow through the mud motor to drill in the direction it is pointed. With steerable motors, when a desired wellbore direction is attained, the entire drillstring may be rotated to drill straight rather than at an angle. By controlling the amount of hole drilled in the sliding mode versus the rotating mode, a wellbore trajectory may be controlled rather precisely.

As an example, a PDM may operate in a combined rotating mode where surface equipment is utilized to rotate a bit of a drillstring (e.g., a rotary table, a top drive, etc.) by rotating the entire drillstring and where drilling fluid is utilized to rotate the bit of the drillstring. In such an example, a surface RPM (SRPM) may be determined by use of the surface equipment and a downhole RPM of the mud motor may be determined using various factors related to flow of drilling fluid, mud motor type, etc. As an example, in the combined rotating mode, bit RPM may be determined or estimated as a sum of the SRPM and the mud motor RPM, assuming the SRPM and the mud motor RPM are in the same direction.

As an example, a PDM mud motor may operate in a so-called sliding mode, when the drillstring is not rotated from the surface (e.g., as in a rotating mode). In such an example, a bit RPM may be determined or estimated based on the RPM of the mud motor. As an example, a drillstring that includes a mud motor may be oscillated using a surface mechanism such as, for example, a top drive. In such an example, the top drive may oscillate the drillstring clockwise and counterclockwise while drilling fluid drives rotation of the mud motor. In such an example, one or more techniques may be employed to control direction of drilling (e.g., bit orientation), extent of oscillations, etc. As oscillations involve both clockwise and counterclockwise motions, such oscillations are not rotations as would be utilized in rotational drilling.

An RSS may drill directionally where there is continuous rotation from surface equipment, which may alleviate the sliding of a steerable motor (e.g., a PDM). An RSS may be deployed when drilling directionally (e.g., deviated, horizontal, or extended-reach wells). An RSS may aim to minimize interaction with a borehole wall, which may help to preserve borehole quality. An RSS may aim to exert a relatively consistent side force akin to stabilizers that rotate with the drillstring or orient the bit in the desired direction while continuously rotating at the same number of rotations per minute as the drillstring.

The module 254 may be an LWD module that may be housed in a suitable type of drill collar and may contain one or a plurality of selected types of logging tools. It will also be understood that more than one LWD module and/or one MWD module may be employed, for example, as represented by the module 256 of the drillstring assembly 250. Where the position of an LWD module is mentioned, as an example, it may refer to a module at the position of the module 254, the module 256, etc. An LWD module may include capabilities for measuring, processing, and storing information, as well as for communicating with the surface equipment. In the illustrated example, the module 254 may include a seismic measuring device.

Where the module 256 is an MWD module (e.g., an MWD tool), it may be housed in a suitable type of drill collar and may contain one or more devices for measuring characteristics of the drillstring 225 and the drill bit 226. As an example, an MWD tool may include equipment for generating electrical power, for example, to power various components of the drillstring 225. As an example, an MWD tool may include the telemetry equipment 252, for example, where one or more turbine impellers may generate power by flow of the mud; it being understood that other power and/or battery systems may be employed for purposes of powering various components. As an example, the module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation may include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well may include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring may include a positive displacement motor (PDM).

As an example, a system may be a steerable system and include equipment to perform method such as geosteering. As mentioned, a steerable system may be or include an RSS. As an example, a steerable system may include a PDM or a turbine on a lower part of a drillstring which, just above a drill bit, a bent sub may be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment may make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, may allow for implementing a geosteering method. Such a method may include navigating a subsurface environment, for example, to follow a desired route to reach a desired target or targets.

As an example, a drillstring may include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering may include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 may include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 may be provided for tracking pipe, tracking movement of at least a portion of a drillstring, etc.

As an example, the system 200 may include one or more sensors 266 that may sense and/or transmit signals to a fluid conduit such as a drilling fluid conduit (e.g., a drilling mud conduit). For example, in the system 200, the one or more sensors 266 may be operatively coupled to portions of the standpipe 208 through which mud flows. As an example, a downhole tool may generate pulses that may travel through the mud and be sensed by one or more of the one or more sensors 266. In such an example, the downhole tool may include associated circuitry such as, for example, encoding circuitry that may encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 may include a transmitter that may generate signals that may be transmitted downhole via mud (e.g., drilling fluid) as a transmission medium.

As an example, one or more portions of a drillstring may become stuck. The term stuck may refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this may refer to a portion of a drillstring that may not be rotated or moved axially. As an example, a condition referred to as "differential sticking" may be a condition whereby the drillstring may not be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking may have time and financial cost.

As an example, a sticking force may be a product of the differential pressure between the wellbore and the reservoir and the area that the differential pressure is acting upon. This means that a relatively low differential pressure (delta p) applied over a large working area may be just as effective in sticking pipe as may a high differential pressure applied over a small area.

As an example, a condition referred to as "mechanical sticking" may be a condition where limiting or prevention of motion of the drillstring by a mechanism other than differential pressure sticking occurs. Mechanical sticking may be caused, for example, by one or more of junk in the hole, wellbore geometry anomalies, cement, keyseats or a buildup of cuttings in the annulus. One or more types of sticking may introduce one or more types of risks, which may be to a borehole wall, equipment, mud, mud flow, etc. In various instances, sticking may introduce non-productive time (NPT), for example, depending on extent of sticking, frequency of sticking, one or more actions taken to reduce sticking, etc.

Figure 3:
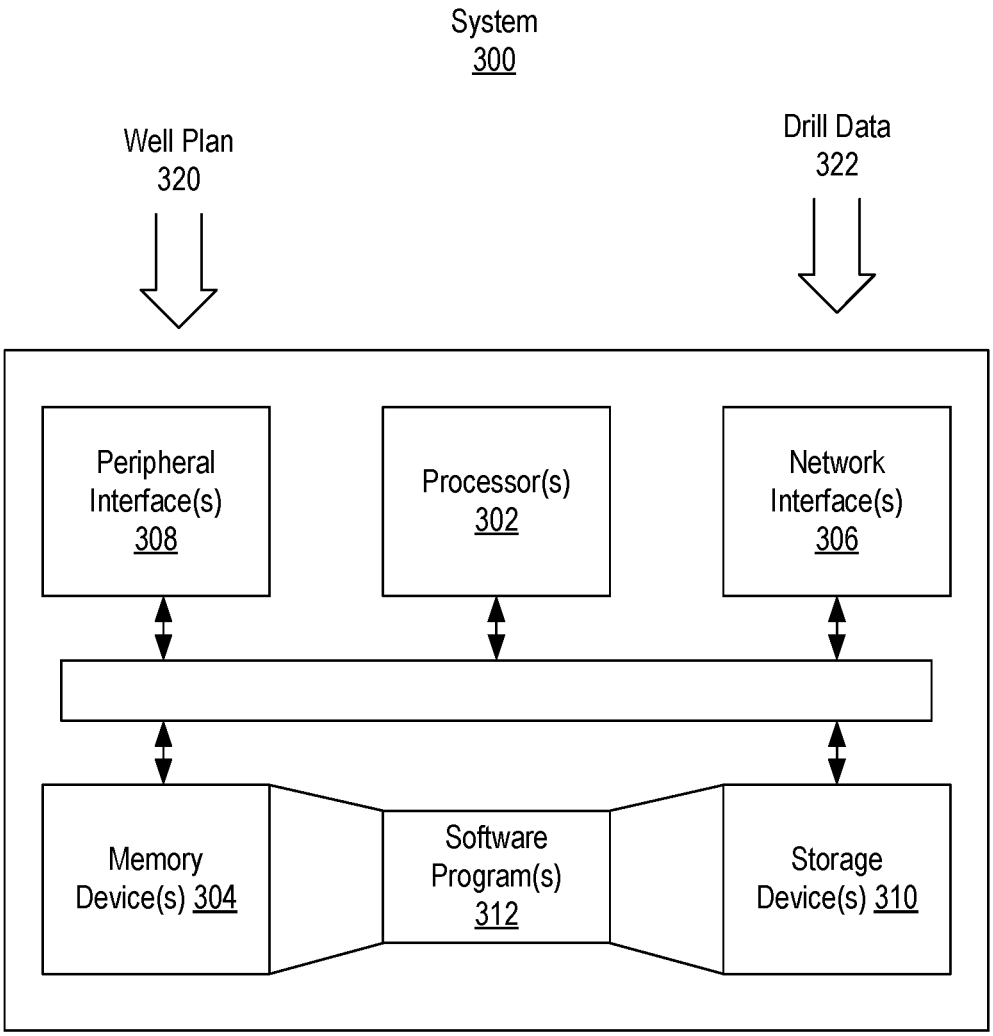
FIG. 3 shows an example of a system.

FIG. 3 shows a schematic view of a computing or processor system 300, according to an embodiment. The processor system 300 may include one or more processors 302 of varying core configurations (including multiple cores) and clock frequencies. The one or more processors 302 may be operable to execute instructions, apply logic, etc. It will be appreciated that these functions may be provided by multiple processors or multiple cores on a single chip operating in parallel and/or communicably linked together. In at least one embodiment, the one or more processors 302 may be or include one or more GPUs.

The processor system 300 may also include a memory system, which may be or include one or more memory devices and/or computer-readable media 304 of varying physical dimensions, accessibility, storage capacities, etc., such as flash drives, hard drives, disks, random access memory, etc., for storing data, such as images, files, and program instructions for execution by the processor 302. In an embodiment, the computer-readable media 304 may store instructions that, when executed by the processor 302, are configured to cause the processor system 300 to perform operations. For example, execution of such instructions may cause the processor system 300 to implement one or more portions and/or embodiments of the method(s) described above.

The processor system 300 may also include one or more network interfaces 306. The network interfaces 306 may include any hardware, applications, and/or other software. Accordingly, the network interfaces 306 may include Ethernet adapters, wireless transceivers, PCI interfaces, and/or serial network components, for communicating over wired or wireless media using protocols, such as Ethernet, wireless Ethernet, etc.

As an example, the processor system 300 may be a mobile device that includes one or more network interfaces for communication of information. For example, a mobile device may include a wireless network interface (e.g., operable via one or more IEEE 802.11 protocols, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope, etc.), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

The processor system 300 may further include one or more peripheral interfaces 308, for communication with a display, projector, keyboards, mice, touchpads, sensors, other types of input and/or output peripherals, and/or the like. In some implementations, the components of processor system 300 need not be enclosed within a single enclosure or even located in close proximity to one another, but in other implementations, the components and/or others may be provided in a single enclosure. As an example, a system may be a distributed environment, for example, a so-called "cloud" environment where various devices, components, etc. interact for purposes of data storage, communications, computing, etc. As an example, a method may be implemented in a distributed environment (e.g., wholly or in part as a cloud-based service).

In the example of FIG. 3, the memory device 304 may be physically or logically arranged or configured to store data on one or more storage devices 310. The storage device 310 may include one or more file systems or databases in any suitable format. The storage device 310 may also include one or more software programs 312, which may contain interpretable and/or executable instructions for performing one or more of the disclosed processes (e.g., processor-executable instructions storable in the memory 304 and executable to instruct the system 300 to perform one or more actions). When requested by the processor 302, one or more of the software programs 312, or a portion thereof, may be loaded from the storage devices 310 to the memory devices 304 for execution by the processor 302.

Those skilled in the art will appreciate that the above-described componentry is merely one example of a hardware configuration, as the processor system 300 may include any type of hardware components, including any accompanying firmware or software, for performing the disclosed implementations. The processor system 300 may also be implemented in part or in whole by electronic circuit components or processors, such as application-specific integrated circuits (ASICs) or field-programmable gate arrays (FPGAs).

The processor system 300 may be configured to receive a directional drilling well plan 320 (e.g., and/or to generate a directional drilling well plan). As discussed above, a well plan is to the description of the proposed wellbore to be used by the drilling team in drilling the well. The well plan typically includes information about the shape, orientation, depth, completion, and evaluation along with information about the equipment to be used, actions to be taken at different points in the well construction process, and other information the team planning the well believes will be relevant/helpful to the team drilling the well. A directional drilling well plan may also include information about how to steer and manage the direction of the well.

The processor system 300 may be configured to receive drilling data 322. The drilling data 322 may include data collected by one or more sensors associated with surface equipment or with downhole equipment. The drilling data 322 may include information such as data relating to the position of the BHA (such as survey data or continuous position data), drilling parameters (such as weight on bit (WOB), rate of penetration (ROP), torque, or others), text information entered by individuals working at the wellsite, or other data collected during the construction of the well.

In one embodiment, the processor system 300 is part of a rig control system (RCS) for the rig (e.g., including downhole equipment operatively coupled to the rig). In another embodiment, the processor system 300 is a separately installed computing unit including a display that is installed at the rig site and receives data from the RCS. In such an embodiment, the software on the processor system 300 may be installed on the computing unit, brought to the wellsite, and installed and communicatively connected to the rig control system in preparation for constructing the well or a portion thereof.

In another embodiment, the processor system 300 may be at a location remote from the wellsite and receives the drilling data 322 over a communications medium using a protocol such as well-site information transfer specification or standard (WITS) and markup language (WITSML). In such an embodiment, the software on the processor system 300 may be a web-native application that is accessed by users using a web browser. In such an embodiment, the processor system 300 may be remote from the wellsite where the well is being constructed, and the user may be at the wellsite or at a location remote from the wellsite.

A well plan 320 typically includes information about the direction and shape of a well to be drilled. The well plan 320 may include information about parameters and tools to use to achieve the desired shape and position. However, as the well is being drilled, the actual trajectory may deviate from the plan or unanticipated conditions may be encountered. In such instances, and others, the plan may need to be adjusted to account for changing conditions and circumstances. For example, consider a method that may call for re-planning to generate a revised well plan.

In one embodiment, a system includes a well plan component for monitoring and updating the well plan where the well plan may be in a digital format, for example, as a digital data structured stored in memory of a computing device, a computing system, etc. For example, consider a controller that includes memory that may store a well plan as a digital file or digital files. The well plan component may derive a working plan when a team takes a survey or otherwise determines a position of a well. In one embodiment, the working plan is, in effect, a spatial trajectory in multiple dimensions to construct a path from a current bit location (e.g., hole bottom position) to a next location, which may be referred to as a target, which may be an intermediate target or a final target. The construction of the path takes into account a variety of considerations. These may include, but are not limited to: the target; the allowable deviation from the original plan in terms of position and/or angular deviation; the maximum dogleg capability of the steering assembly; constraints set by the user at the beginning based on preference; allowable tortuosity, risk measures, hole quality, confidence level, etc.; and others.

The generation of the working plan may involve generating a range of trajectory candidates that satisfy a number of the different conditions specified and evaluating the candidates based on the trajectory context, different properties, constraint violations, and rank. The trajectories may be ranked according to different optimization objectives. The user may have the system present one or more of the available candidates for selection.

As an example, the path of a wellbore, or its trajectory, may be determined by acquiring direction and inclination (D&I) measurements at various points along the wellbore, which may be referred to as survey measurements or survey information. With respect to a survey, position of a wellbore (e.g., a borehole, etc.), may be referenced to some vertical and/or horizontal datum (e.g., a well-head position and elevation reference). The position may be obtained using one or more inertial measurement techniques. As to azimuth, it may be considered to be a directional angular heading, for example, relative to a reference direction, such as North, at the position of measurement. As to inclination, it may be considered to be an angular deviation of a borehole from vertical, for example, with reference to the direction of gravity. As to measured depth, it may be considered to be a distance measured along a wellbore (e.g., a borehole, etc.) from a surface location. Measured depth may include a driller's depth, and it may also include depth correction algorithms, that account for the elastic stretching and compression of a drillstring along its length.

Directional wellbores may be drilled through earth formations along a selected trajectory. Various factors may combine to unpredictably influence the trajectory of a wellbore. It is desirable to accurately measure the wellbore trajectory in order to guide the wellbore to its geological and/or positional target. Thus, it is desirable to measure the inclination, azimuth and depth of the wellbore during wellbore operations to estimate whether the selected trajectory is being maintained.

The drilled trajectory of a wellbore may be estimated via acquisition of a wellbore or directional survey, which may be referred to herein as a survey that is not an expansive surface-based seismic survey that acquires a seismic cube of data for a volume of earth. A wellbore survey may be made up of a collection or a set of survey stations. A survey station may be generated by taking measurements used for estimation of position and/or wellbore orientation at a single position in a wellbore (e.g., a borehole, etc.). The act of performing these measurements and generating the survey data may be referred to as performing a survey or surveying a wellbore or a borehole.

Surveying of wellbores may be performed using downhole survey instruments (e.g., drillstring equipment). Such instruments may include, for example, one or more orthogonal accelerometers, magnetometers and/or gyroscopes. Survey instruments may be used to measure the direction and magnitude of the local gravitational, magnetic field and/or earth spin rate vectors respectively (e.g., collectively earth vectors). Various measurements may correspond to instrument position and orientation in a wellbore, with respect to earth vectors. As an example, wellbore position, inclination and/or azimuth may be estimated from instrument measurements.

One or more survey stations may be generated using discrete or continuous measurement modes. Discrete or static wellbore surveys may be performed by creating survey stations along a wellbore when drilling is stopped or interrupted, for example, to add additional joints or stands of drillpipe to the drillstring at the surface. Continuous wellbore surveys may relate to various measurements of the earth's vectors and/or angular velocity of a downhole tool obtained for each wellbore segment using one or more survey instruments. Successive measurements of these vectors during drilling operations may be separated by fractions of a meter and, depending on rate of change of the vectors in drilling a wellbore, such measurements may be considered continuous or they may be considered discrete.

Figure 4:
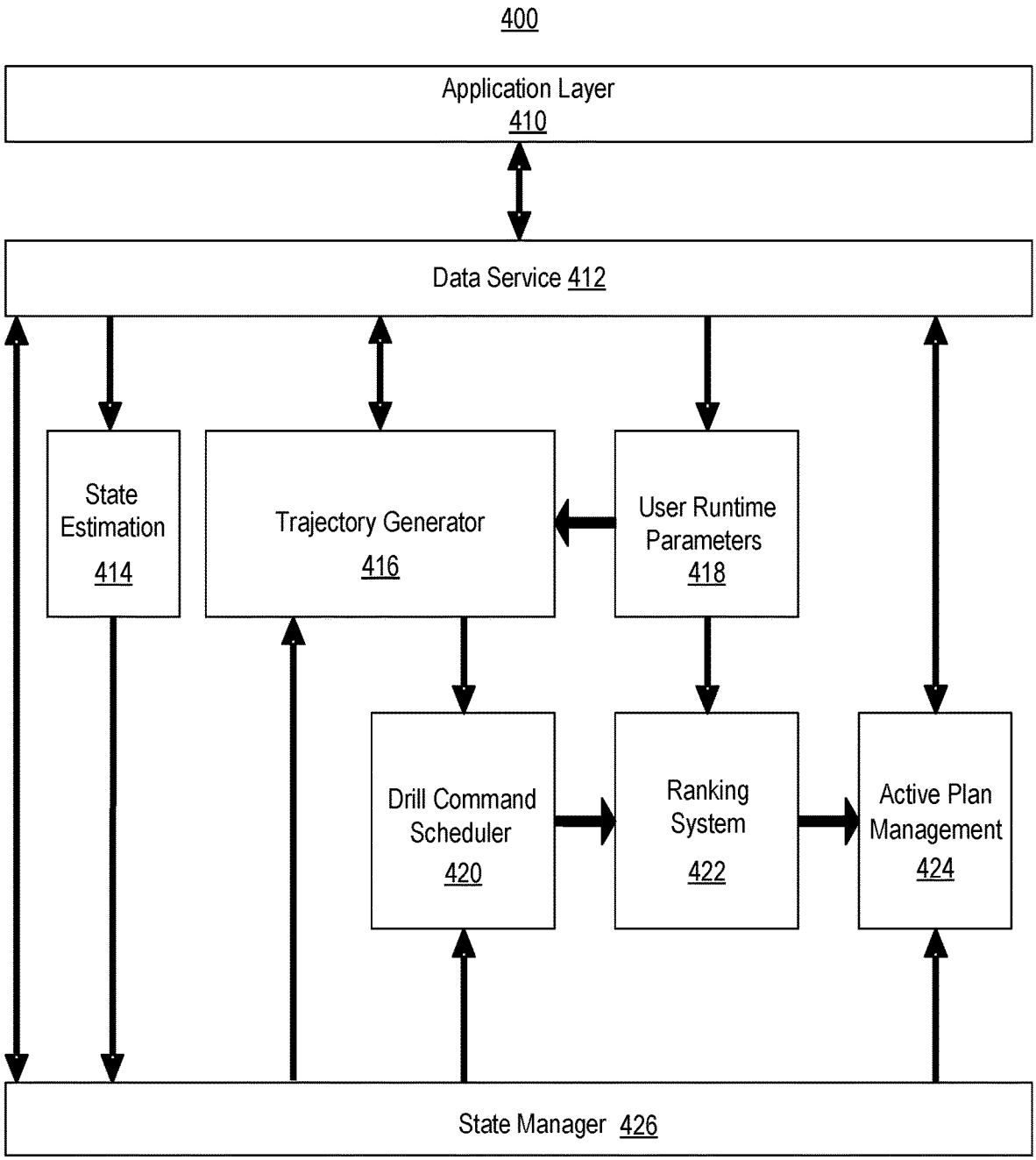
FIG. 4 shows an example of a system.
Figure 5:
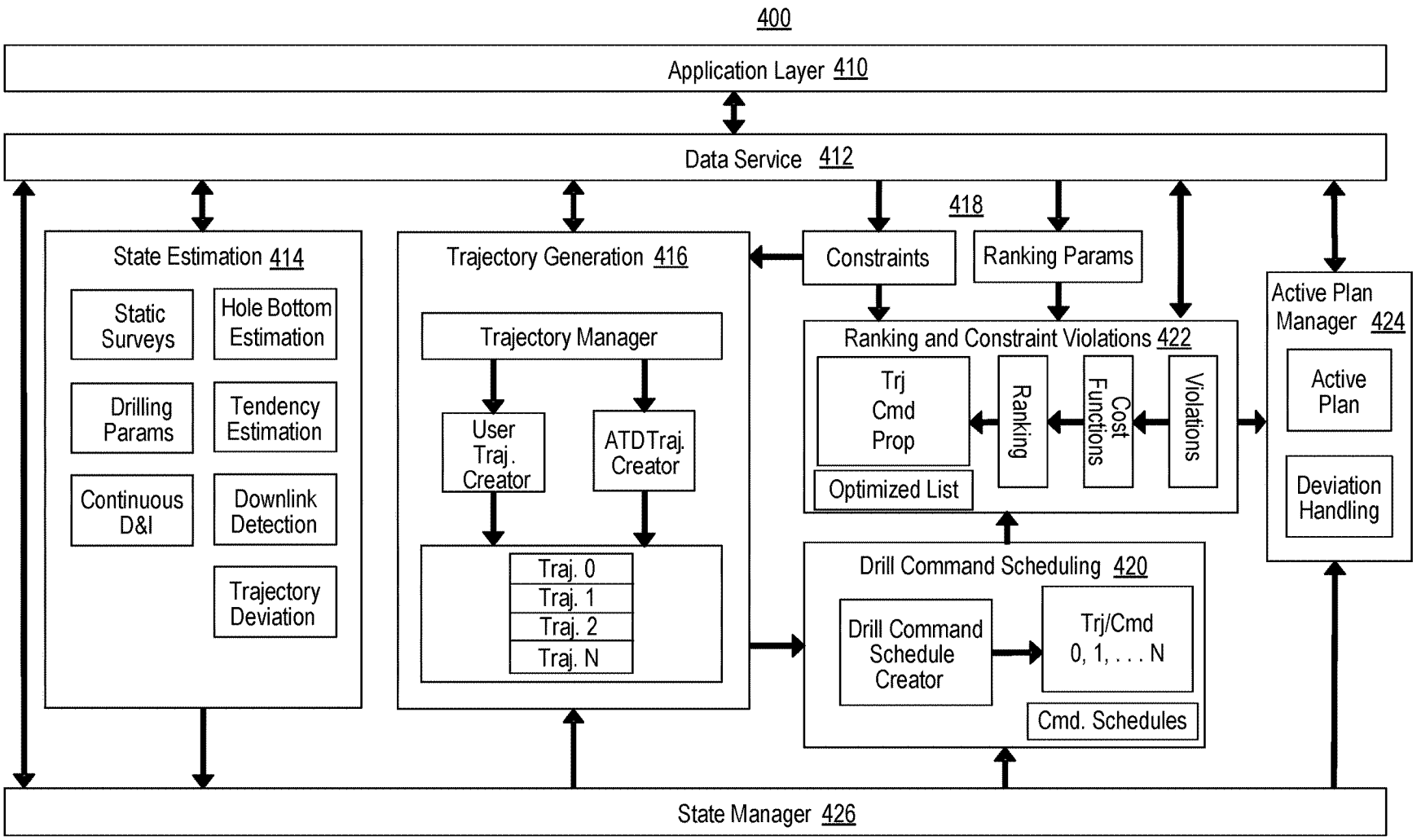
FIG. 5 shows an example of a system.

FIG. 4 and FIG. 5 illustrate one embodiment of a system 400 for working plan generation (e.g., a working plan generator (WPG)). As shown, the system 400 may include an application layer 410, a data service 412, a state estimation component 414, a trajectory generator component 416, a user runtime parameters component 418, a drill command scheduler component 420, a ranking system component 422, an active plan management component 424 and a state manager component 426.

In one embodiment, the system 400 includes the state estimation component 414 for inferring the state of a system using incoming data from the data service 412. As shown in the example of FIG. 4, the state estimation component 414 may include various features, such as, for example, one or more of features for static surveys, hole bottom estimation, drilling parameters estimation, tendency estimation, continuous direction and inclination (D&I) estimation, downlink detection, trajectory deviation estimation, etc. As to hole bottom estimation, it may be performed in one or more manners. As an example, a framework for hole bottom estimation may be utilized that may implement one or more types of filters, which may be model dependent. In such an example, a framework may operate dynamically to automatically select a particular filter and/or a particular model. For example, a model may be a predictive model that may be utilized by a filter that includes a prediction-correction architecture. As an example, a hole bottom estimation process may estimate orientation of a drill bit of a drillstring (e.g., attitude) using data that may include data acquired during drilling operations. As an example, an estimation process may include filtering or not filtering. As an example, an estimation process may utilize a linear regression filter, a piecewise linear with changes in steering settings, a multivariate piecewise linear filter, a multi-variate piecewise linear filter with uncertainties, one or more types of Kalman filters (e.g., extended Kalman filter, unscented Kalman filter, etc.), a particle filter, a basic median filter, a Gaussian process-based filter, etc. As an example, one or more filters may be implemented using one or more machine learning techniques. For example, consider a neural Kalman filter where modeling of process dynamics and sensory observations may be parameterized using one or more neural networks.

As an example, hole bottom estimation as part of a state estimation process may provide for improved drilling operations. For example, consider improved steering of a drill bit, which may aim to maintain a drill bit in a desired layer such as, for example, a reservoir layer (e.g., to increase reservoir contact of a borehole, etc.). As an example, hole bottom estimation may improve candidate generation, choice of trajectory, choice of commands and/or command scheduling, recommendations, etc. As an example, hole bottom estimation may improve tendency estimation for trajectory interpolation. As an example, hole bottom estimation may be utilized in a generation process that generates candidate trajectories where the candidate trajectories extend from an estimated hole bottom depth and orientation to one or more targets. Hence, with a more accurate estimation of hole bottom depth and orientation, candidate trajectories may be more reliably generated.

As an example, the state manager component 426 may be configured to handle multiple parallel states for determining the effects of certain actions that a user (e.g., or machine) may want to take or that may occur and infer the state from these 'what-if' scenarios. In the example of FIG. 4, the trajectory generator component 416 may interface with multiple trajectory creation sources/states and manage multiple trajectory candidates.

As to the drill command scheduler component 420, it may generate hardware specific drill command sequences for each trajectory (e.g., command schedules for each trajectory). As to the ranking system component 422, it may evaluate constraint violations and properties sort candidates according to user-defined optimization objectives. In the example of FIG. 4, the active plan manager component 424 may monitor in-progress actions and make/suggestion corrections, trigger replanning actions, and request user intervention.

In one embodiment, the trajectory evaluation and ranking approach as illustrated in FIG. 5 may evaluate constraint violations for the generated candidates; noting that it may also evaluate the cost functions for multiple candidate properties. In certain embodiments, a user may prioritize and/or weight parameters being optimized. A component may also generate a prioritized list of candidates for the user to choose from.

In one embodiment, the trajectory evaluation and ranking solver takes as input the trajectories and drill command schedules from the command scheduler; noting that it may also receive constraint configurations, constrain violation penalties, and candidate property weights. The output may be, in one embodiment, a prioritized list of candidates.

Figure 6:
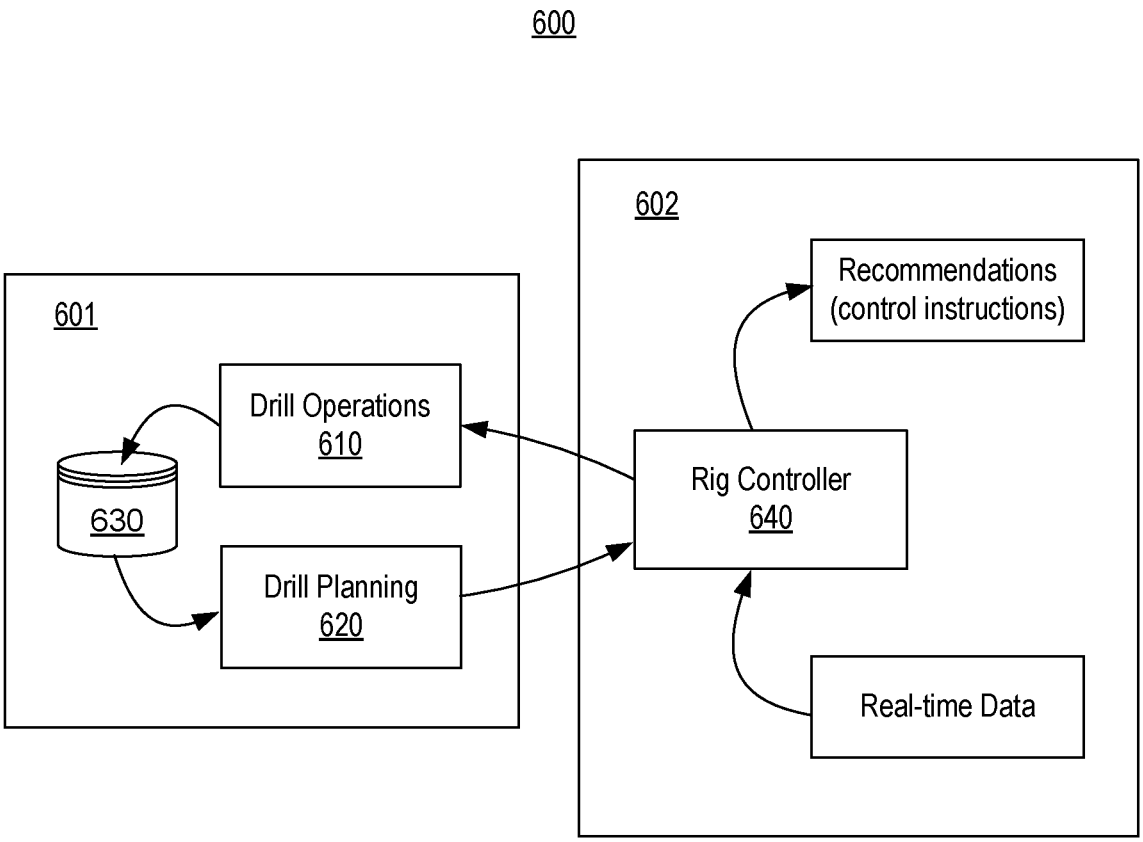
FIG. 6 shows an example of a system.

FIG. 6 shows an example of a system 600 that includes offsite equipment 601 (e.g., remote) and onsite equipment 602 (e.g., local). As shown, the offsite equipment 601 may include a drill operations framework 610, a drill planning framework 620 and a database 630 and the onsite equipment 602 may include a controller 640 that may receive real-time data and output recommendations such as control instructions to control onsite equipment. In such an example, the drill operations framework 610 may provide for steering sheets, execution parameters, etc., and the drill plan framework 620 may provide for evaluation of steering responses and statistics. As shown, the controller 640 may output information to the drill operations framework 610 and receive information from the drill plan framework 620. The system 600 may include plan generation features for real-time plan generation during drilling operations execution phase and/or plan generation during a planning phase. The system 600 may be utilized for one or more types of drilling (e.g., rotary, mud motor, RSS, ABSS, etc.). The system 600 may operate loops, which may include at least one real-time loop that provides for control of equipment to perform drilling operations.

A system such as the system 600 may utilize various functions and penalties for generation of plans, which may provide for single or multiple target aiming. As explained, a plan may be generated that aims to provide for drilling operations that aim for multiple targets simultaneously. As an example, the system 600 may include one or more features of the system 400 of FIGS. 4 and 5, one or more other systems described herein, etc.

Figure 7:
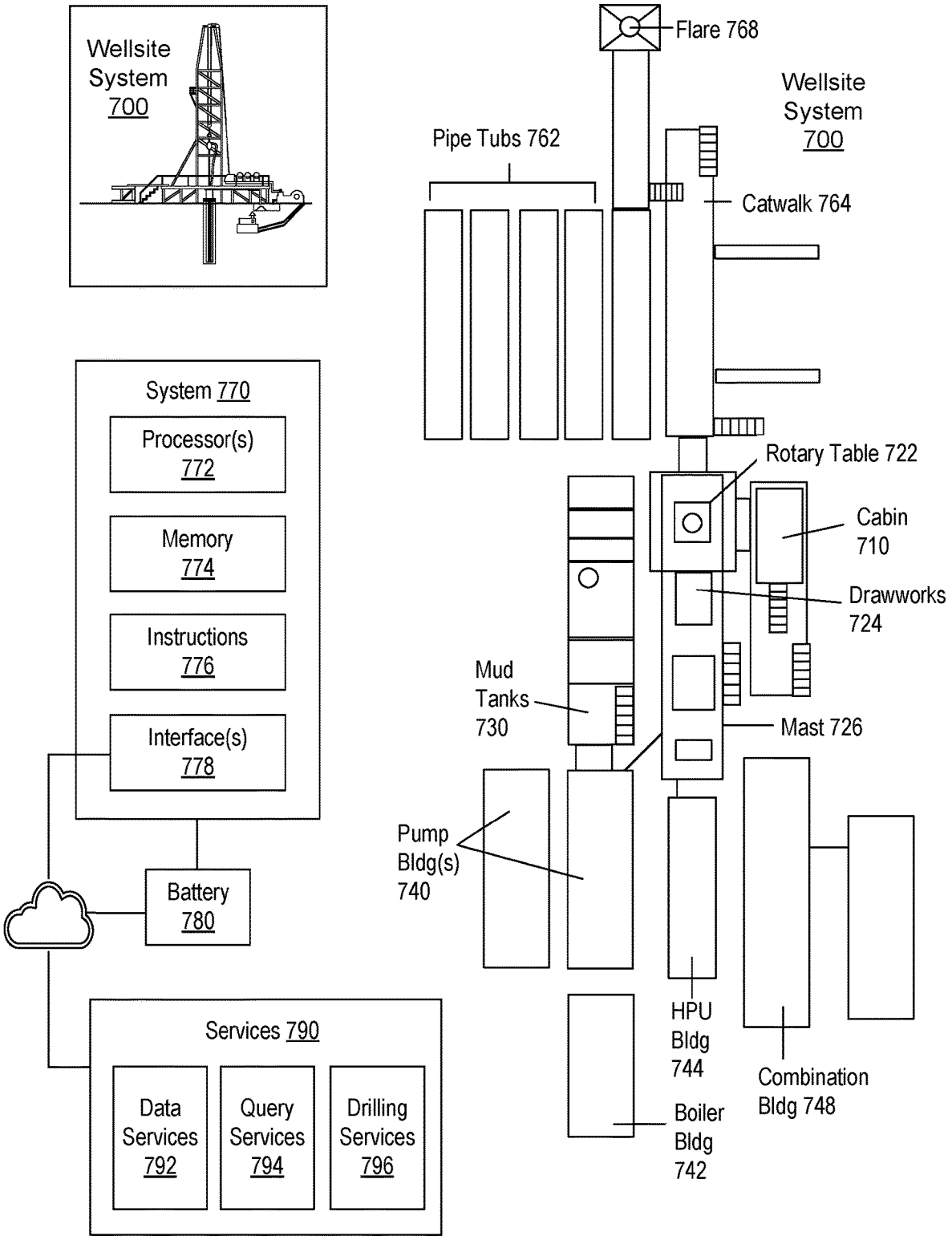
FIG. 7 shows an example of a system.

FIG. 7 shows an example of a wellsite system 700, specifically, FIG. 7 shows the wellsite system 700 in an approximate side view and an approximate plan view along with a block diagram of a system 770.

In the example of FIG. 7, the wellsite system 700 may include a cabin 710, a rotary table 722, drawworks 724, a mast 726 (e.g., optionally carrying a top drive, etc.), mud tanks 730 (e.g., with one or more pumps, one or more shakers, etc.), one or more pump buildings 740, a boiler building 742, an HPU building 744 (e.g., with a rig fuel tank, etc.), a combination building 748 (e.g., with one or more generators, etc.), pipe tubs 762, a catwalk 764, a flare 768, etc. Such equipment may include one or more associated functions and/or one or more associated operational risks, which may be risks as to time, resources, and/or humans.

As shown in the example of FIG. 7, the wellsite system 700 may include a system 770 that includes one or more processors 772, memory 774 operatively coupled to at least one of the one or more processors 772, instructions 776 that may be, for example, stored in the memory 774, and one or more interfaces 778. As an example, the system 770 may include one or more processor-readable media that include processor-executable instructions executable by at least one of the one or more processors 772 to cause the system 770 to control one or more aspects of the wellsite system 700. In such an example, the memory 774 may be or include the one or more processor-readable media where the processor-executable instructions may be or include instructions. As an example, a processor-readable medium may be a computer-readable storage medium that is not a signal and that is not a carrier wave.

FIG. 7 also shows a battery 780 that may be operatively coupled to the system 770, for example, to power the system 770. As an example, the battery 780 may be a back-up battery that operates when another power supply is unavailable for powering the system 770. As an example, the battery 780 may be operatively coupled to a network, which may be a cloud network. As an example, the battery 780 may include smart battery circuitry and may be operatively coupled to one or more pieces of equipment via a SMBus or other type of bus.

In the example of FIG. 7, services 790 are shown as being available, for example, via a cloud platform. Such services may include data services 792, query services 794 and drilling services 796. As an example, the services 790 may be part of a system such as the system 600 of FIG. 6, another system described herein, etc. As an example, the services 790 may include one or more services for directional drilling, which may include, for example, a steering tendency service or services (e.g., consider a computational framework that may provide for one or more services that utilize survey information to estimate one or more steering response parameters, etc.).

As an example, the system 770 may be utilized to generate one or more rate of penetration drilling parameter values, which may, for example, be utilized to control one or more drilling operations.

As an example, a method may include automating operations of one or more types of downhole tools. For example, consider automating operations of one or more of mud motors, rotary steerable systems (RSSs) and at-bit steerable systems (ABSSs). As an example, one or more of such types of equipment, systems, etc., may be implemented using one or more features of the system 200 of FIG. 2. For example, the drillstring assembly 250 may include one or more of a mud motor, an RSS, an ABSS, etc.

As an example, an at-bit steerable system (ABSS) may include an actuator with a pressure drop range, hold inclination and azimuth (HIA), and dual downlinking capabilities. As an example, an ABSS may include onboard near-bit sensors that may acquire continuous six-axis inclination and azimuth measurements, for example, with a 6-ft range, and optional natural gamma ray and azimuthal images, for example, with a 9-ft range. As an example, an ABSS may include one of more features of one or more of the NEO-STEER family of ABSSs (SLB, Houston, Texas).

As an example, a framework may provide for considering information from planning with offset analysis and adapting a hybrid model for real time execution; considering various downhole automation possibilities at a given time to optimize a recommended working trajectory execution, taking advantage of tool capabilities and minimizing unnecessary surface actions; considering real-time data information and derived tool health as well as tool state estimation at a given point in time to optimize current ongoing recommendation and recommend real time correction to handle deviations when it occurs. Such an approach may involve different computations and actions that may output an optimal recommendation, for example, for a fastest path with minimized risk based on the drilling constraints and the drilling context.

As to an optimal path recommendation, derivation may be via a WPG, for example, as explained with respect to FIG. 4 and FIG. 5, which may provide for a single-target approach and/or a multi-target approach and, for example, which may account for various factors, which may include energy, emissions, etc.

Figure 8:
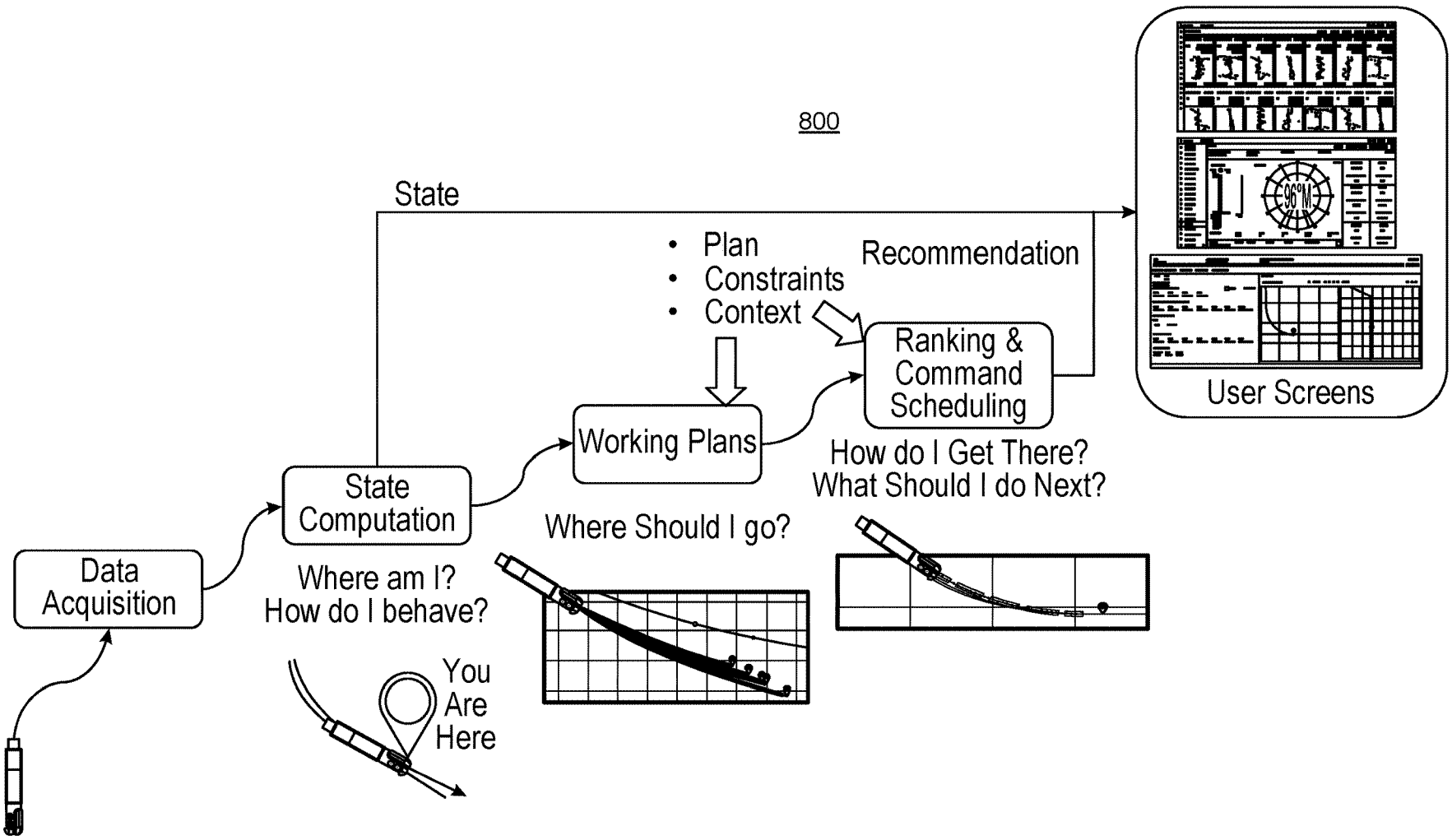
FIG. 8 shows an example of a workflow.

FIG. 8 shows an example of a workflow 800 that includes data acquisition, state computation, working plans generation, ranking and command scheduling and user selections. As shown, such a workflow may be implemented during drilling operations at a site. For example, data acquired may be real-time data and state computation may compute a state of where a BHA or other tool is located in a wellbore. As to working plan generation, it may answer the question of where to proceed, which may be based on a current plan, constraints and context. As explained, ranking and command scheduling may be performed where commands may be suitable for automated and/or manual execution. Recommendations from such a workflow may be rendered to one or more displays where, for example, one or more GUIs may provide for user interactions.

As explained, a working plan may be or include a trajectory to construct a path from a current bit location (e.g., a hole bottom (HB) point) to a next target (e.g., another hole bottom (HB) point). The construction of such a path may be performed in accordance with aiming at a target where, for example, various trajectory constraints may be considered. For example, consider one or more of the following constraints: allowable deviation from an original plan both in terms of position but also angular deviation; maximum dogleg capability of a steering assembly; recommended constraints by an automatic plan analysis that may be adjustable manually and/or automatically (e.g., according to user preferences, etc.); and allowable tortuosity, risk measures, hole quality, confidence level, etc.

As explained, working plan generation may be performed using a trajectory generator (e.g., for generating multiple trajectory candidates with different conditions) and a ranking system (e.g., for evaluating each of the generated candidates based on trajectory context, different properties, constraint violations, etc.). In such an approach, a WPG may output a single best candidate or few top ranked candidates.

As to the ranking system, it may operate based on a list of classification items that define features selected in order to rank the candidates. For example, consider candidate properties where some examples of these properties may include: trajectory length, ROP, total steering length, toolface (TF) orientation, maximum steering ratio, average deviation from the plan, risk level, target constraints, angular deviation, tortuosity and one or more other torque and drag constraints, directional difficulty index (DDI), hole quality, tool wear, number of downlinks, geomechanics, confidence level and production level index. For each property, i, utilized (e.g., from i=1 to I, I being a total number of properties), a weight $W_i$ may be defined based on trajectory context, basin location, type of client, type of rig, etc. In such an example, the weight may be associated with a cost function of the candidate to produce a total cost for each candidate trajectory as:

$$C_{prop} = \sum_i C_i W_i$$

Above, each property, denoted i, may have a cost $C_i$ and an associated weight $W_i$, which may be a context dependent weight, where a total cost for candidate properties of a candidate trajectory may be a sum, $C_{prop}$. Such a ranking system may be modular and extensible. Defining a ranking system in such a manner may facilitate adding additional candidate properties (e.g., according to mathematical and/or logical descriptions). For example, using a machine learning approach, a system may map out from historical data how easy or difficult it was to drill a path and define a drilling difficulty index from surface automation and add it to the foregoing equation. In such an example, one or more cost functions may be optimized in a manner that may account for ease and/or difficulty of drilling. As an example, a system may optionally include a cost function that estimates greenhouse gas (GHG) emissions for each path (e.g., candidate). In such an example, when a cost function is associated with carbon emissions or GHG emissions, a ranking system may be run in a mode (e.g., emissions mode) where weights may be selected to minimize emissions first (e.g., prior to other minimization(s)).

As an example, once an optimal path has been selected and steering commands to achieve the path are defined, there may be an additional optimization problem of defining a link with surface automation equipment to execute the optimal path efficiently. Such an approach may be performed in an iterative manner, for example, by deriving the optimal drilling parameters after the working plan has been generated or it may be performed simultaneously by incorporating surface automation constraints inside a ranking system (e.g., in an extensible manner, etc.). As an example, a system may use an artificial intelligence-based planner to determine a set of possible drilling parameters to use when a working plan has been generated.

As mentioned, an intelligent execution component may control steering commands whether it is for one or more of motor steering, RSS steering or ABSS steering. In certain embodiments, a control layer may be provided when running an RSS tool or ABSS tool (e.g., as to availability of direct downhole trajectory automation).

As to various aspects of drilling, consider the following terms.

- Rotary Steerable System (RSS): particular downhole tool capable of deviating the wellbore with electronic commands.
- Dogleg Severity (DLS): measure of the change in direction of a well bore over a defined length, normally measured in degrees per 100 feet of length.
- Yield (Y): the maximum DLS capability.
- RealTime Yield (RT Y): the yield at a particular time.
- ToolFace (TF): the angle measured in a plane perpendicular to the drillstring axis that is between a reference direction on the drillstring and a fixed reference.
- Desired Commands: the intended command sent to the downhole tool.
- Actual Commands: the resulting command executed by the downhole tool.
- ToolFace Offset ($TF_o$): the angle measured between the desired TF and the actual TF.
- Build Rate (BR): the DLS projected in the vertical plane attached the tool location. It is also the rate of change in Inclination.
- Turn Rate (TR): the DLS projected in the horizontal plane. It is also the rate of change in azimuth.
- Walk Rate (WR): the rate of change of azimuth attached to the tool reference axis.
- Steering Ratio (SR): the percentage of time the RSS tool is spending steering (bias) vs trying to go neutral (unbias).
- $BR_o$ and $WR_o$: BR and WR during neutral phase.

As an example, an automated method may estimate steering tendency parameters for an RSS during well construction execution. In such an example, parameters may include the yield (e.g., the maximum DLS capability of the steering tool), the neutral build (e.g., the tendency to build or drop angle during neutral phase when no particular direction is privileged), the neutral turn (e.g., the tendency to turn during neutral phase) and the toolface offset (e.g., the angular discrepancy between aimed and actual).

Figure 9:
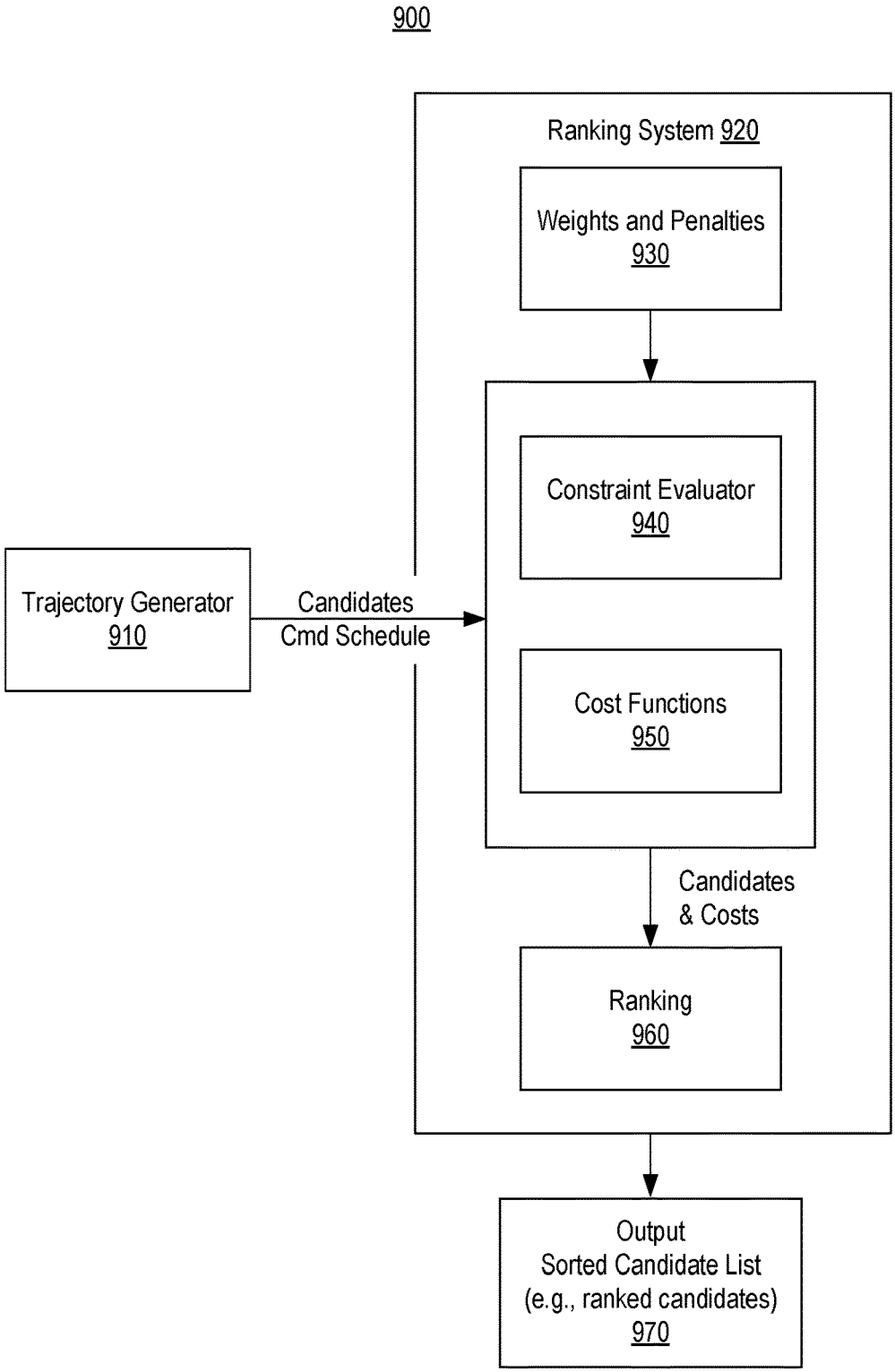
FIG. 9 shows an example of a system.

FIG. 9 shows an example of a system 900 that includes a trajectory generator 910 and a ranking system 920. As shown, the trajectory generator 910 may generate candidates and a command schedule while the ranking system 920 includes a weights and penalties block 930, a constraint evaluator block 940, a cost functions block 950 and a ranking block 960. The system 900 may generate output as indicated by an output block 970 for a sorted candidate list (e.g., ranked candidates). As an example, the system 400 of FIG. 4 may include the ranking system 920, for example, as the ranking system component 422, and may include the trajectory generator 910, for example, as the trajectory generator component 416. As shown in FIG. 5, the ranking system component 422 may be a system for handling ranking and constraint violations. As explained, ranking may be performed using weights, for example, a weight may be associated with a cost function of a candidate to produce a total cost for each candidate trajectory. For example, in the system 900, the weights and penalties block 930 may provide and/or generate appropriate weights, penalties (e.g., constraints), etc.

As an example, a system may include one or more components (e.g., blocks, etc.) that may automatically derive values of weights for a ranking system. As explained, such a ranking system may be part of or otherwise operatively coupled to a working plan generator (WPG). As explained, such a WPG may be utilized for field operations such as, for example, directional drilling. As an example, a WPG may be part of a directional drilling advisory system.

As an example, a ranking system may utilize one or more machine learning techniques to derive appropriate values for weights to use based on observed behavior from actual directional drilling (DD) operations, for example, as performed by one or more humans and/or one or more automated system set-up on a rig.

As explained, a system may implement an automatic methodology to derive values of weights for a ranking process that may be included as part of working plan generation for a directional drilling advisor (DDA).

Due to the complexity of various wells being drilled, substantial risk and reward scenarios exist for proper planning and execution of DD of wells. A system may aim to so-called de-skill and de-man a DD process while ensuring efficiency and consistency. As an example, a DD framework may provide for various levels of de-skilling and de-manning a DD process while ensuring efficiency and consistency. In such an example, a DDA framework may provide, in real-time, optimal decisions (e.g., perform real-time optimal decision making). As an example, a DDA framework may provide output for one or more of motors, trajectories, commands, and downlink recommendations. For example, consider a DDA framework that provides output for an RSS tool and/or one or more other types of tools for directional drilling. Such a framework may provide output for various types of wells, for example, from start to end by automatically providing at each survey point a next sequence of actions.

A DDA framework may enable well construction with minimal human intervention and provide for monitoring and/or intervention, locally and/or remotely (e.g., at a rig or from town). As explained, a DDA framework may include a WPG system that may determine how to construct an optimum path from a present state to one or more target objective states.

A WPG may be implemented as a system within a DDA framework (e.g., consider an RSS Advisor framework) where the WPG is in charge of deriving working plans to be followed, for example, responsive to taking a survey and updating a position of a well (e.g., a hole bottom position).

A working plan may be, in effect, a trajectory to construct a path from a current bit location (e.g., a hole bottom (HB) position) to a next target. The construction of such a path may be accomplished in accordance with aiming for a target and optionally also by taking into account one or more trajectory constraints such as, for example: allowable deviation from an original plan in terms of position and angular deviation; maximum dogleg capability of a steering assembly; constraints set by a user at initiation (e.g., based on his/her preferences); allowable tortuosity; risk measures; hole quality; confidence level; ROP; carbon emissions; eco-optimal path (e.g., with minimal energy consumption); etc.

As explained, generation of a working plan may include trajectory generation, which may aim to generate an appropriate number of trajectory candidates' different conditions, along with ranking, which may aim to evaluate each of the candidates based on one or more of a trajectory context, different properties, constraint violations, etc., to rank available candidates according to a defined optimization objective (e.g., optionally user defined).

As to output from a ranking process (e.g., a ranking system), output may be a single best candidate or, for example, a few best candidates that may be exposed to a user for selection, optionally using one or more techniques such as, for example, a Pareto technique to select a candidate when no single candidate of the few best candidates is substantially optimally better than another one of the few best candidates (e.g., a trade-off selection process).

Referring again to the example system 900 of FIG. 9, such a system may be employed for RSS applications, mud motor applications and/or one or more other types of DD applications. As shown, the ranking system 920 includes a constraint evaluator block 940, which may provide for evaluating trajectory constraints and applying a penalty for each violation, and a cost functions block 950, which may provide for evaluating candidate properties and applying a cost to each property. As an example, the ranking block 960 may receive candidates and costs and sort the candidates, for example, in an order of ascending cost (e.g., ranking by cost).

As to weight generation, which may be performed by the weights and penalties block 930 of the ranking system 920 of FIG. 9, it may generate weights that include property weights that may be utilized to sort numerous candidates.

As explained, a system may act to derive an optimum path to reach one or more targets from a current hole position (e.g., a current HB position). In such an example, a user may want to know the optimum path to reach one or more targets given a current hole position and constraints associated with a current context. As to constraints, consider, for example, one or more of yield, allowable deviation from an original plan, attitude constraints, etc. In various examples, a system may provide at least depth and orientation of a HB where, for example, depth may be measured depth or true vertical depth (TVD) and orientation may include inclination and azimuth. Where HB position is mentioned, it may refer to HB depth and orientation. In such an approach, depth may be a one-dimensional position or may be a multidimensional position. For example, TVD may be one-dimensional and measured depth may be one-dimensional or multidimensional.

As an example, a function may consume HB position (e.g., depth and orientation) and one or more targets as inputs and develop an optimum path to the one or more targets as an output. In such an example, inputs may include, for example, one or more of HB estimation (HBE), tendency, and one or more targets. In such an example, output may include one or more working plans. As an example, a configuration may include use of an original plan along with trajectory constraints and type of tool (e.g., RSS or mud motor).

As an example, during geosteering, a function may use an output HBE to better understand position of a borehole with regards to a reservoir and then advise proper geosteering commands to either get back inside a safe zone of the reservoir or derive steering commands to stay within a more productive area of the reservoir when the borehole is already positioned inside the reservoir. Such an approach may improve directional drilling in reservoirs that may be relatively thin where drilling outside of a reservoir layer may be non-productive and waste energy and time. As an example, geosteering may be implemented to maintain a drill bit in a particular layer as defined between a roof (e.g., an upper layer) and a floor (e.g., a lower layer), which may be defined by boundaries or interfaces (e.g., with other layers of rock, etc.). In various instances, directional drilling aims to meet a desired amount of contact between a borehole and a reservoir.

Figure 10:
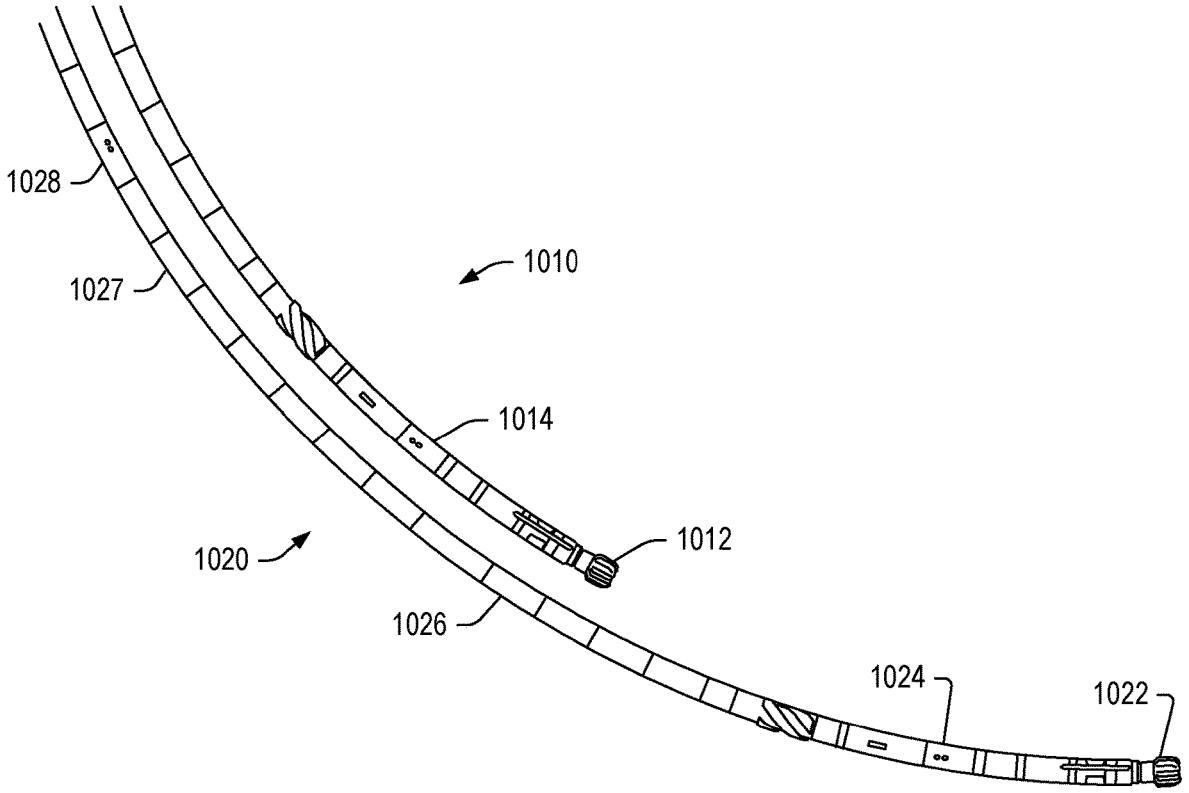
FIG. 10 shows examples of drillstrings.

FIG. 10 shows an example of a drillstring 1010 with various BHA features and an example of a drillstring 1020 with various BHA features. As an example, the drillstrings 1010 and 1020 may include one or more of the features of the drillstring assembly 250 of FIG. 2. As shown in the examples of FIG. 10, the drillstring 1010 includes a drill bit 1012 and a group of direction and inclination (D&I) sensors 1014 that are positioned relatively close to the drill bit 1012 while the drillstring 1020 includes a drill bit 1022, a group of D&I sensors 1024 that are positioned relatively close to the drill bit 1022, one or more other D&I sensors 1026, a D&I gyroscope sensor 1027, and one or more D&I MWD sensors 1028. In such examples, the closer a sensor is to a drill bit, in general, the more accurately the sensor may provide an indication of a downhole position of the drill bit, which, as explained, may provide for HB estimation (HBE). As explained with respect to the system 400, the data service 412 may acquire data for one or more purposes, which may include data for utilization by the state estimation component 414, which may provide for HBE.

As to a gyroscope sensor, consider, as an example, a gyroscope sensor that includes one or more features of the GYROSPHERE tool (SLB, Houston, Texas). As an example, a gyroscope sensor may provide for acquisition of gyro-surveying data in a manner that may help to an ellipse of uncertainty. As an example, a gyroscope sensor may include microelectromechanical systems (MEMS) technology that may utilize the Coriolis effect, for example, consider use of a vibrating structure that may provide for determination of a rate of planetary rotation. As an example, such a rate may be sensor data that may be utilized to determine one or more of inclination, azimuth, and toolface orientation. As an example, a gyroscope sensor may provide for survey data during a connection of drillpipe. For example, a measurement may be taken during a connection where the measurement may be available immediately after mud pumps are on (e.g., making data available more rapidly) due to MEMS technology not having to spin up and stabilize. As an example, two surveys may be performed in the time a non-MEMS gyroscope takes to start up for just one survey. As an example, a gyroscope sensor may be a MEMS technology-based sensor that may handle relatively severe shock and vibration. As an example, a single sensor may be utilized to survey at an inclination, at a depth, and at higher latitudes, without a demand for changing batteries or recalibrating between runs, which may make batch-drilling operations more efficient. As an example, one or more gyroscope sensors may be included on a drillstring. As an example, an RSS tool may include a gyroscope sensor. As an example, a drilling may include a gyroscope sensor in a module or unit that may be assembled on a drillstring (e.g., a tool with a length that makes up part of a length of a drillstring). As an example, an MWD tool may include a gyroscope sensor.

As an example, an MWD tool may include various sensors for acquiring data, which may include survey data such as, for example, direction and inclination (D&I) data. An MWD tool may be powered electrically using one or more mechanisms. For example, consider a battery, a fluid turbine generator, etc. Where multiple mechanisms are included, they may provide for redundancy and increased up-time. For example, a battery may provide for operation during intermittent drilling-fluid flow conditions. Battery power may also provide for logging during tripping in (running in hole (RIH)) or out of the hole (pulling out of hole (POOH)). As such, an MWD tool on a drillstring may acquire data for the same location multiple times as it passes the location during drilling, RIH, POOH, etc.

As to sensors, an MWD tool may include directional-sensor technology that may, for example, utilize an array of three orthogonal fluxgate magnetometers and three accelerometers. While standard directional sensors may provide acceptable surveys, in scenarios where uncertainty exists in a bottomhole location, more sophisticated sensor technology may help to reduce such uncertainty. Yet, as explained, even with more sophisticated sensor technology, uncertainty may still exist, which may be exacerbated by recent trends to drill longer and more complex wells. Various types of errors may also exist for MWD measurements, which may include, for example, one or more of sensor error, magnetic interference from the BHA, tool misalignment, and magnetic-field uncertainty.

As to MWD telemetry, mud-pulse telemetry is a standard method in various commercial MWD and LWD systems, noting that one or more other types of telemetry may be utilized, additionally or alternatively. Demands on telemetry may be imposed by real-time azimuth correction, which involve transmission of raw data to surface. Further, telemetry may introduce uncertainties when compression/decompression are utilized (e.g., with loss or lossless) and general types of transmission errors (e.g., noise, physical events, etc.).

As to an MWD survey, recordings of MD, inclination, and hole direction may be taken at a survey station where a number of survey stations may be obtained along a path. Such measurements may be used together to calculate 3D coordinates, which may then be presented as a table of numbers called a survey report. Surveying may be performed during a drilling run, while RIH, POOH, after drilling has been completed, etc. An MWD survey of an MWD tool of a drillstring demands that breaking rock with a drill bit of the drillstring is halted (e.g., drilling suspended) such that the MWD tool may remain stationary in an environment with diminished noise to acquire sensor data for the MWD survey. An MWD survey may be utilized for one or more purposes such as, for example, one or more of determining a bottomhole location to monitor reservoir performance, monitoring an actual path to help ensure a target will be reached, orienting deflection tools for navigating paths, reducing risks of intersecting a nearby well, computing the TVD of various formations to allow for geological mapping, evaluation DLS, and fulfilling requirements of regulatory agencies, such as the Minerals Management Service (MMS) in the US. As to the latter, if an ability to survey using an MWD tool on a drillstring becomes impractical or impossible, drilling may be terminated until the issue is resolved, for example, to assure compliance with regulatory requirements, to reduce risk of colliding with another borehole, wellbore, etc.

Where an RSS tool is utilized, one or more of downlinks and uplinks may be employed. Downlinks may be commands transmitted for receipt by an RSS tool. Such downlinks may employ rotational techniques such as adjusting drillstring RPM as a signal (e.g., via a top drive) that encodes a command and/or flow techniques such as adjusting flow of drilling fluid (e.g., mud) as a signal (e.g., via one or more mud pumps) that encodes a command. As an example, one or more techniques may involve use of a surface listener as a type of equipment that may sense the RPM and/or flow adjustments. For example, a surface listener may sense pressure and then associate sensed pressure data with downlink codes. In such an example, the surface listener may understand and confirm downlinks to an RSS tool (e.g., knowing what commands may have been sent). A surface listener may be helpful in the instance where, for one or more reasons, uplinks are not possible or otherwise unreliable. For example, an uplink may be a signal generated by an RSS tool that is destined for receipt by an MWD tool where the MWD tool may employ mud-pulse telemetry to convey the signal (e.g., or content thereof) to surface. Thus, various points of failure may exist for uplinks. For example, an RSS tool may be unable to generate an adequate uplink that is receivable by an MWD tool or an MWD tool may be unable to adequately receive and/or interpret an uplink. Where one or more issues exist, a surface listener may provide a record of commands (downlinks) transmitted to an RSS tool to help understand a current state of the RSS tool (e.g., assuming commands have been received and implemented). Hence, a blind mode of operation may be defined where an MWD tool is operable to provide at least survey information and where uplinks from an RSS tool are not available. In such a mode, information from a surface listener may be utilized as a surrogate for uplink information (e.g., to understand state of an RSS tool). As an example, a blind mode may be defined as a type of mode where signals originating with an RSS tool are not received or receivable at surface (e.g., for one or more reasons).

As an example, through use of a surface listener and/or other technology, the state of an RSS tool may be inferred. Such inferences may be utilized during one or more modes. For example, such inferences may be made during non-blind and/or blind modes. Where they are made during non-blind modes, the inferences may be compared to actual states that may be based on uplink information. Such comparisons may be utilized to improve the ability to infer states of an RSS tool (or RSS tools), which may help to improve blind mode operation. In some instances, a command may be misinterpreted by an RSS tool, for example, due to degradation of an RPM and/or flow rate sequence (e.g., high, low, etc.) that encodes the command. For example, consider an uplink from an RSS that indicates "going right" when a surface listener infers that a downlink to the RSS was "go left". In such an example, the differences may be assessed to determine whether another command is to be sent to assure proper operation. In such an example, if the number and/or type of discrepancies rise to or beyond a threshold or thresholds, a system may trigger operation of a blind mode if the RSS uplink information is deemed unreliable and/or may trigger an assessment of why a downlink may be experiencing one or more issues.

As an example, an RSS tool may include sensors that may provide for measurements of one or more of inclination offset to tool bottom, azimuth offset to tool bottom, average gamma ray, gamma ray offset to tool bottom, vibration axial, vibration radial, shock, triaxial shock and vibration axis, magnetic field cone of exclusion, etc. As an example, sensors may include one or more of gyroscopic sensors, accelerometers, magnetometers, gamma ray sensors, shock and vibration sensors, pressure sensors, temperature sensors, etc. As an example, sensors may be arranged as a group or a package. As explained, a sensor or sensors may be positioned along a drillstring, which may be at one or more distances from a drill bit of the drillstring.

As explained, an RSS tool may include D&I sensors and/or one or more other sensors that acquire data where the data may be stored locally and/or transmitted. As explained, an RSS tool may utilize uplink technology to transmit data from the RSS tool to an uphole MWD tool, as may be located a distance from the RSS tool on a common drillstring. As explained, a blind mode may be utilized when the uplink from an RSS tool to an MWD tool is "broken"; noting that lack of information from telemetry of an MWD tool to surface may be a reason for terminating drilling (e.g., lack of an ability to receive MWD survey information at surface). As to types of technology for uplink transmission, an RSS tool may include an interface for a wired connection to an interface of an MWD tool. Where such a wired connection is an external connection, it may be exposed to various forces, which may cause wear over time or otherwise hinder transmission. As an example, uplink transmission may utilize electromagnetic radiation telemetry as a wireless form of transmission. Accordingly, an uplink may be transmitted from an RSS tool to an MWD tool via one or more of wired and wireless technologies. Further, an approach may provide for unidirectional from RSS to MWD or bidirectional between RSS and MWD. Where bidirectional is available, an MWD tool may issue a command to an RSS tool, for example, to inquire as to state, sensor data, etc. In various instances, a wired approach may provide for bidirectional transfers whereas a wireless approach may provide solely for unidirectional transfers. Where unidirectional transfers are employed, an RSS tool may repeatedly transmit information until a change in state of the RSS tool (e.g., new sensor data, new command, etc.).

As an example, where a mud motor is utilized on a drillstring with an MWD tool and without an RSS tool, data from the MWD tool may be utilized in a mud motor mode. In various instances, a drillstring may include an MWD tool and may include a mud motor and an RSS tool; whereas, in general, a mud motor or an RSS tool will be present for directional drilling.

As explained, a borehole may have a direction and a BH may have an orientation. For example, consider a borehole orientation that may be described in terms of inclination and azimuth. Inclination generally refers to the vertical angle measured from the down direction where down, horizontal, and up directions have inclinations of 0 degrees, 90 degrees and 180 degrees, respectively. Azimuth generally refers to the horizontal angle measured clockwise from north, which may be a type of "north" or defined "north". In general, north, east, south and west directions have azimuths of 0 degrees, 90 degrees, 180 degrees and 270 degrees, respectively. In drilling, azimuth may be defined as a compass direction of a directional survey or of a wellbore as planned or measured by a directional survey where, for example, the azimuth may be specified in degrees with respect to a geographic north, a magnetic north pole, or another defined "north". As an example, a BH may be defined as a flat surface (e.g., a planar surface) with an orientation that may be defined by a vector that points in a direction normal to the flat surface. In such an example, a BH may be defined by a position (e.g., a measured depth) and an orientation (e.g., a direction). As an example, a system may provide for maintaining proper reference to one or more directions (e.g., north, south, east, west, etc.). Maintaining proper reference may facilitate directional drilling in relatively thin layer reservoirs that may have an upper true vertical depth (TVD) limit and a lower TVD limit. Geosteering in such reservoirs may be challenging though improved when a proper reference is maintained (e.g., to assure proper reservoir contact between a borehole and a reservoir). As explained, a system may help to maintain a proper reference through developing a series of estimated BHs (e.g., position and orientation) along a borehole.

As an example, one or more types of measurements may provide for assessing uncertainty of one or more other types of measurements. For example, temperature may be utilized to assess uncertainty of a sensor with respect to its operational temperature range. In such an example, if a temperature is measured that is outside of an operational temperature range for a sensor, measurements from that sensor may have greater uncertainty. As an example, a mode may be selected based in part on uncertainty, for example, consider a blind mode or another mode that may operate without a particular measurement or measurements if uncertainty is above an uncertainty threshold. As another example, shock and vibration may impact one or more types of measurements, where shock and/or vibration may be utilized as types of measurements that may help to assess uncertainty. As an example, such uncertainties may be carried forward in computation of a HB position (e.g., depth and orientation).

As an example, an earth model may provide for pressure and temperature modeling with respect to depth (e.g., true vertical depth (TVD)). In such an example, measured pressure and/or measured temperature may be compared to values, gradients, etc., of an earth model, which may help to increase accuracy of and/or otherwise check a HB position (e.g., an HBE).

As mentioned, a working plan may be or include a trajectory to construct a path from a current bit location (e.g., a HB position) to a next target location (e.g., a desired HB position). As an example, a framework may include features that may implement an automatic method to estimate the position of a bottom of a hole (HB) during well construction execution. For example, along a BHA, the position of one or more sensors that may be used to estimate a location of a borehole may be within three meters of a drill bit (e.g., less than approximately three meters but greater than approximately 20 cm) or they may be a considerable distance from a drill bit (e.g., more than 3 m, 5 m, 10 m, 30 m, etc.). In such an example, where measurements of sensors are used, some type of predictive model is generally required to estimate the exact, actual location of a bottom of a hole (HB). For example, even when a group of sensors is located within one meter of a drill bit, an estimation or prediction may be required for an HBE. As an example, a framework may include one or more features that may improve HBE where such one or more features may provide for more accurate and automated estimation of the exact, actual location of a bottom of a hole (HB).

As an example, a framework may include one or more features for optimal filtering that consumes, in real-time (RT), one or more types of downhole information (e.g., D&I, etc.) for providing an estimation of one or more HB parameters, for example, with uncertainties and continuous trajectory interpolation along with extrapolation outputs. In such an example, the framework may provide for estimation of HB position and/or drill bit position during directional drilling activities.

As mentioned, modern wells may be relatively complex and thereby pose an increased number of risk and reward scenarios for proper planning and execution. As to automation, whether in planning and/or execution, automation may aim to de-skill and de-man a directional drilling process while ensuring efficiency and consistency. For example, with automation, demand for on-site personnel may be lessened (e.g., fewer people) and/or skill level(s) of on-site personnel may be lessened and/or shifted (e.g., shifted to automation oversight versus directional drilling decision making).

As explained, an autonomous directional drilling (DD) system may aim to achieve one or more goals, for example, through use of an automated directional drilling advisor framework that provides real-time optimal decision-making. As an example, an autonomous DD system may provide for automation levels of various workflows. For example, consider one or more workflows motor control, trajectories, commands and/or downlink recommendations for one or more RSSs. Such an autonomous DD system may be suitable for one or more of multiple types of wells where it may automatically provide, from start to end of a section, at each survey point, an appropriate next sequence of actions.

As an example, a next sequence of actions may be quite relevant during one or more geosteering applications where, for example, relative position of a borehole is specified with respect to a reservoir, for example, to a achieve desired amount of reservoir contact. In such an example, via a look-ahead indication of geosteering, directional drilling may derive an improved working plan to stay within a pay zone of a reservoir.

As explained, an autonomous DD system may include a DDA that enables well construction with minimal human intervention either from the rig or from a location remote from the rig (e.g., office location, etc.). As mentioned, an autonomous DD system, which may be a computational framework, may incrementally progress through an automated evaluation of a current bit position that may be in view of an initial plan or a revised plan. In such an example, the evaluated current bit position may be an on-bottom position that may be equated to or otherwise used for estimation of a HB position. Such a HBE process may provide a core parameter that drives a DDA. As an example, for RSS applications, a framework may utilize an RSS tool direction and inclination (D&I) sensor group, which tend to be closer/more proximate to a drill bit when compared to MWD tool D&I sensors (see, e.g., FIG. 10). However, in various instances, the RSS D&I sensors have a relatively low azimuth measurement precision, especially when drilling around a zone of exclusion, as may occur for various North America sites. Such a precision issue may have a substantial effect on DDA estimations.

As explained, a method may be implemented automatically for estimating the HB position and orientation. In such an example, the method may utilize one or more sensors that may be at one or more distances from a drill bit of a drillstring. For example, consider a method that may combine RSS D&I, MWD D&I and a tendency estimation to output an accurate HB position, even when drilling through a zone of exclusion. Such a method may provide acceptably accurate estimations even in challenging scenarios such as when direction drilling involves drilling parallel to the Earth's magnetic field.

As an example, a DDA may include features for performing HBE such that the DDA is tasked with locating the HB position to know its relative position with respect to an initial plan along with one or more upcoming drilling targets.

As an example, a DDA may provide for a relatively continuous and automated output of HB positions. In such an example, the DDA may provide for position of a drill bit and orientation of the drill bit while outputting HB position estimates (e.g., D&I along with HBE). As an example, a DDA may output information at a frequency of every 15 cm (e.g., 0.5 ft) of directional drilling. As an example, a framework may provide for predicting future HB positions according to current and/or future commands, which may be specified as part of a digital plan for directional drilling. In such an example, environmental conditions, mechanical conditions, one or more other well positions, etc., may be taken into account.

As an example, a framework may generate information for a drilled portion of a well where such information may include details as to actual depth and orientation of a drill bit at points in time. For example, consider a framework that may generation a graphical user interface (GUI) with a trajectory of at least a drilled portion of a borehole where a user may hover or click on the trajectory to instruct the GUI to display information such as actual depth and orientation of the drill bit and hence a longitudinal axis of the borehole. For example, consider output of a vector that has a base point for actual position where the vector points in an orientation that may correspond to the orientation of a drill bit that drilled the trajectory at that base point.

As an example, a framework may provide continuous estimate of hole orientation by fusing different systems and sensor measurements where output may be at a frequency of approximately every 15 cm (e.g., approximately 0.5 ft). In such an example, the framework may provide for a projection of a future borehole position that is deeper (e.g., with respect to measured depth) than a current borehole position (e.g., BH position). As an example, a framework may support anti-collision drilling such that directional drilling occurs with a reduced risk of drilling into or close to one or more other existing boreholes. As an example, a framework may provide for true trajectory recovery at a selected measured depth that is less than a current hole depth (e.g., HB position). As an example, a framework may support a blind mode estimation process that may be operated responsive to occurrence of one or more issues, triggers, etc., and/or that may be operated in a background manner where, for example, comparisons may be made between a blind mode estimation of HB position and a non-blind mode estimation of HB position. As to a non-blind mode estimation of HB position, it may be a mode that operates at least in part on at least one sensor measurement. As an example, a full mode of operation for at least HBE may involve acquiring a number of sensor measurements. As an example, a framework may provide for one or more advanced survey workflows.

As an example, a blind mode may be operated in an intermittent manner, for example, where a measurement or measurements are not available. As an example, a blind mode may be operated in a planned manner or a blind mode may be operated in an unplanned manner. As to a planned manner, it may relate to one or more telemetry related scenarios where, for example, information from an RSS sensor group is not available in a timely manner. As to an unplanned manner, it may be implemented upon occurrence of one or more issues. For example, consider one or more of a sensor failure during a drilling run, an elevated level of shock and/or vibration that may detrimentally affect one or more sensor measurements, a telemetry failure or interruption that causes one or more sensor measurements to not be received and/or to be received outside of a time window, etc. As to a scenario where one or more measurements are delayed (e.g., outside of a time window), a framework may utilize one or more delayed measurements to reconstruct an HBE, which as explained, may be stored to a database such that actual positions and orientation may be rendered, etc., after drilling has occurred.

As an example, directional drilling may occur where at least a portion of a trajectory may be drilled with assistance from a framework (e.g., a DDA) operating at least in part in a non-blind mode. As an example, directional drilling may occur with assistance from a framework (e.g., a DDA) operating in a mode for at least HBE. In such an example, the directional drilling may use a drillstring without an RSS tool where, for example, measurements from one or more sensors disposed a distance from a drill bit of the drillstring may be utilized for at least HBE. As an example, a framework may perform at least HBE without information from an RSS. In various instances where data from an RSS (e.g., an RSS tool) are unavailable, a blind mode may be utilized that is "blind" due to unavailability of the data from the RSS.

As explained, a framework may provide for a projection that projects a future position or positions where such a projection may be utilized for one or more purposes. For example, consider a projection that extends more than approximately 10 meters (e.g., 30 m, 60 m, etc.) to help reduce risk of a trajectory approaching or intersecting an existing borehole.

As an example, a HBE may include a HB position (e.g., a depth in a one-dimension or in a multi-dimensional space, along a longitudinal axis of a borehole) along with orientation of the HB (e.g., hole bottom orientation (HBO)). As explained, an orientation may be represented by a vector, which may be normal to a plane that represents a HB at a measured depth. As an example, an HBO may be specified using an inclination and an azimuth. As to inclination, it is a measure of deviation from vertical, irrespective of compass direction, expressed in degrees. Inclination may be measured initially with a pendulum mechanism and, for example, may be confirmed with measurements from one or more MWD accelerometers or gyroscopes. For most vertical wellbores, inclination is the only measurement of the path of the wellbore. For intentionally deviated wellbores, or wells close to legal boundaries, directional information may also be measured. In directional drilling, the azimuth may be the compass direction of a directional survey or of the wellbore as planned or measured by a directional survey. As mentioned, azimuth may be specified in degrees with respect to a geographic north, a magnetic north pole or another convention (e.g., grid north, etc.).

As explained, a framework may assist with directional drilling where directional drilling may be performed using one or more types of tools (e.g., mud motor, RSS, etc.). As to a mud motor tool, directional drilling may involve sliding and rotating where sliding may be utilized for generating a curved borehole. As explained, during sliding (e.g., a sliding mode), a top drive may oscillate a drillstring clockwise and counterclockwise while, during rotating (e.g., a rotating mode), a top drive may rotate a drillstring in a single direction. As an example, a framework may provide for various directional drilling modes. As an example, a drillstring may include a mud motor and an RSS where, for example, one or the other is utilized by itself for steering a drill bit along a curve.

As an example of a hybrid system may be utilized that may be configured to drill using an RSS with assistance of power from a mud motor (e.g., consider a no-bend mud motor that is locked straight). In such an example, the RSS may be responsible for steering (e.g., without use of a sliding mode). For example, consider the POWER DRIVE VORTEX system (SLB, Houston, Texas), which has an integrated power section that may convert mud hydraulic power to mechanical energy to help maximize power, for example, to drill into hard formations.

Figure 11:
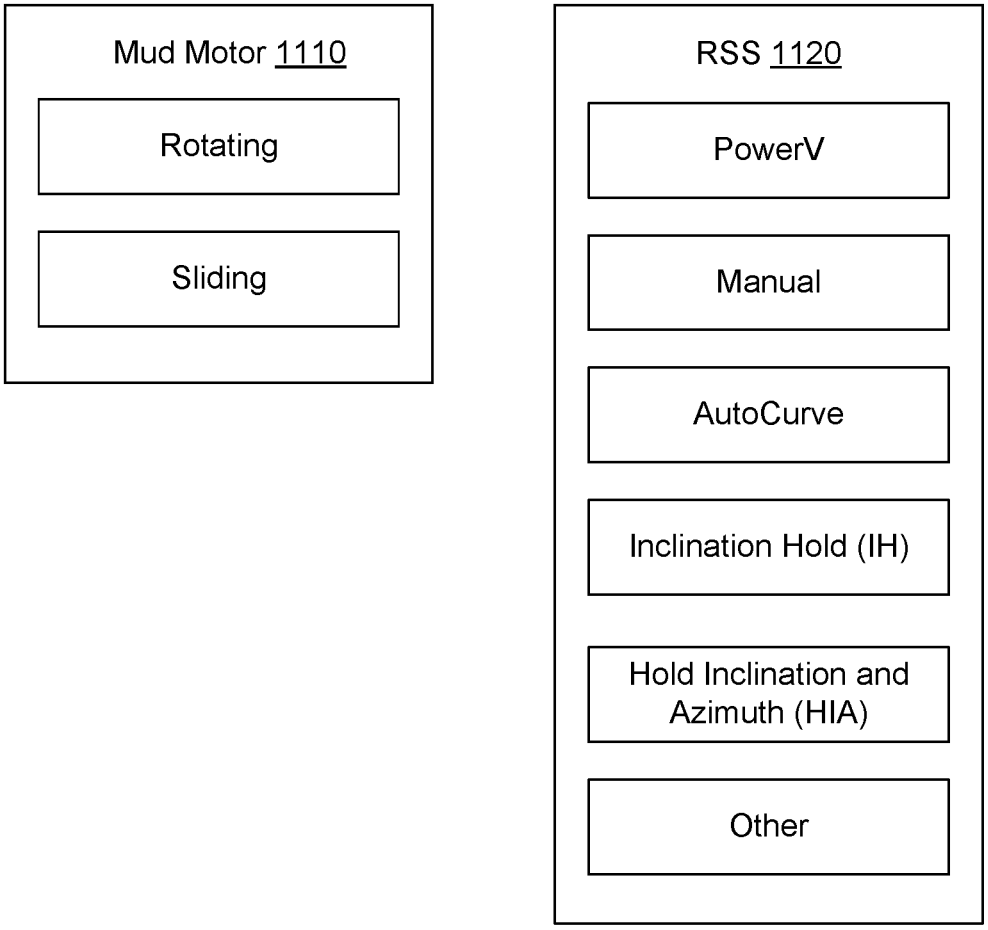
FIG. 11 shows examples of drilling modes.

FIG. 11 shows an example of mud motor modes 1110 and an example of RSS modes 1120 where the mud motor modes 1110 include rotating and sliding and where the RSS modes 1120 include PowerV (e.g., vertical), Manual, AutoCurve, Inclination Hold (IH), Hold Inclination and Azimuth (HIA), and one or more other modes. As an example, a framework may provide for selection of a mode where the mode is associated with a model. For example, a mode may be a drilling mode that is associated with a drilling mode model. In such an approach, adaptive filtering may be employed where such filtering may consume in real-time (RT) downhole information (e.g., direction and inclination (D&I), etc.) to provide an estimation of hole bottom parameters, for example, with uncertainties. Such an approach may provide for continuous trajectory interpolation and/or extrapolation outputs. As explained, a model may be selected for a particular mode, which may be a drilling mode. In such an approach, the selected model may utilize data for hole bottom estimation. For example, a selected model may be for a current mode of drilling such that data may be appropriately utilized for hole bottom estimation (HBE). Such an approach may be dynamic in that where a change occurs in drilling mode, a change may occur in a model utilized for HBE.

Figure 12:
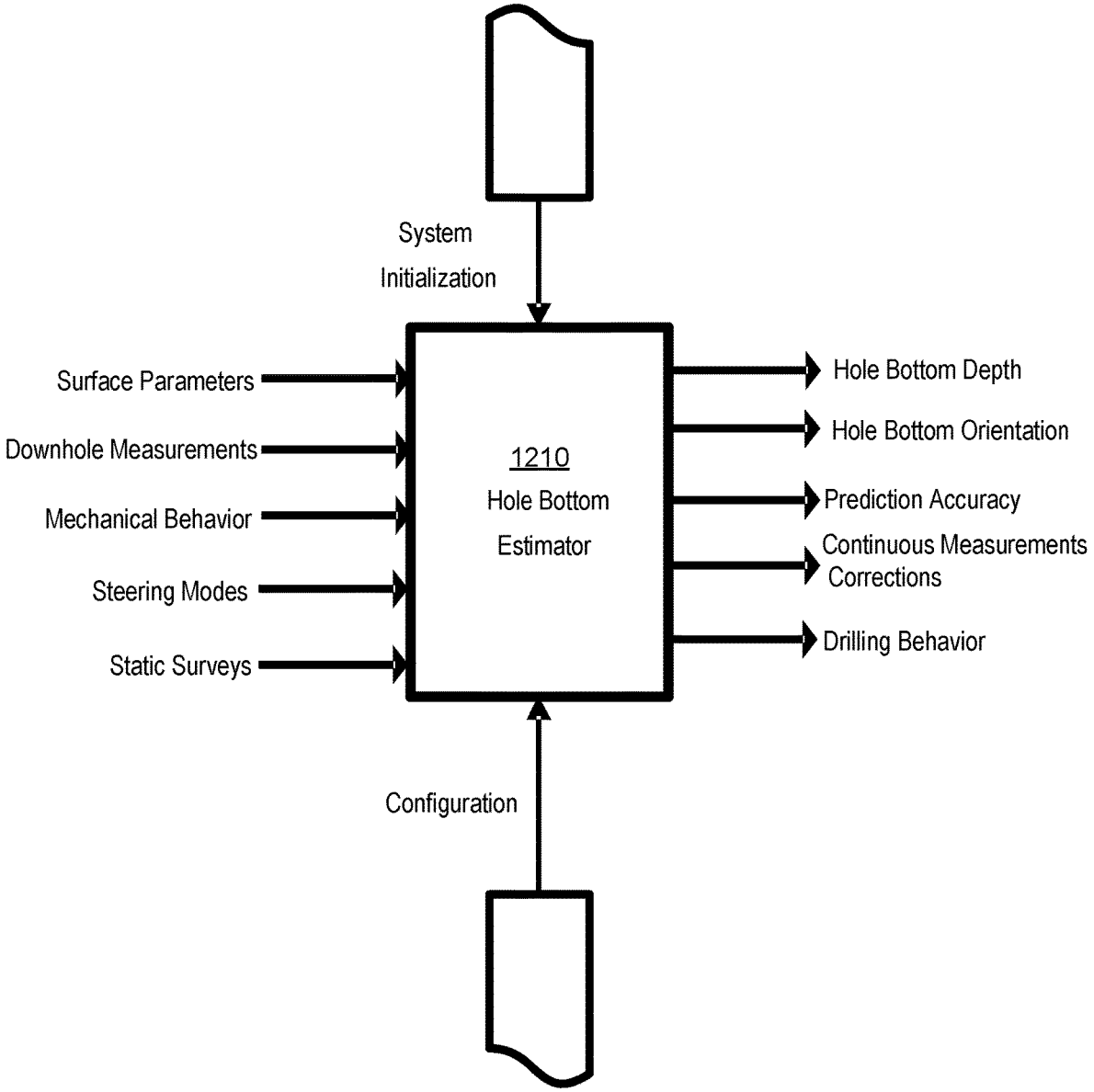
FIG. 12 shows an example of a framework.

FIG. 12 shows an example of at least a portion of a framework 1200 that includes a HB estimator 1210. As shown, the HB estimator 1210 may be initialized and configured, for example, using digital plan information, etc. As to inputs, in the example of FIG. 12, the HB estimator 1210 may receive surface parameters, downhole measurements, mechanical behavior, steering modes and static surveys (e.g., surveys taken where drilling is temporarily halted such as, for example, during a time where a stand is being added to a drillstring). As to outputs, in the example of FIG. 12, the HB estimator 1210 may generate HB depth, HB orientation, prediction accuracy, continuous measurements corrections and drilling behavior. As to static surveys, these may increase time to drill, which may be considered as non-productive time (NPT). Thus, the number of static surveys may be minimized. As an example, a static survey may provide orientation information (e.g., inclination and azimuth) at depth of one or more sensors.

As to surface parameters, consider, for example, one or more of timestamp, hole depth, bit depth, ROP, RPM, toolface (TF), hook load (HKLD), standpipe pressure (SPP), differential pressure (DiffP or delta p), torque (TOR), WOB, and block position (BPOS). As to downhole measurements, consider, for example, one or more of continuous MWD surveys, continuous gyroscopic sensor surveys, continuous RSS surveys, desired toolface, desired steering proportion, actual steering proportion, tool status, downlinks, attitude targets (e.g., inclination and azimuth), downhole temperature, measurement accuracy, RPM at drill bit, and downhole pressure. As to mechanical behavior, consider, for example, one or more of shock and vibration, drill string buckling, borehole diameters(s), BHA specifications, steering tendencies. As to steering modes, consider, for example, one or more of the modes shown in FIG. 11. As to static surveys, consider, for example, one or more of static surveys, gyroscopic sensor surveys, MWD surveys, and measurement accuracy.

As to HBO as an output, consider, for example, one or more of measured depth, inclination, azimuth, true vertical depth (TVD), North-South (e.g., northing), East-West (e.g., easting), and vertical section. As to prediction accuracy as an output, consider, for example, one or more of measured depth accuracy, inclination accuracy, and azimuth accuracy. As to continuous measurements corrections as an output, consider, for example, one or more of MWD/gyroscopic inclination correction, MWD/gyroscopic azimuth correction, RSS inclination correction, and RSS azimuth correction. As to drilling behavior as an output, consider, for example, one or more of dogleg severity (DLS), build rate (BR), turn rate (TR), and toolface (TF).

Figure 13:
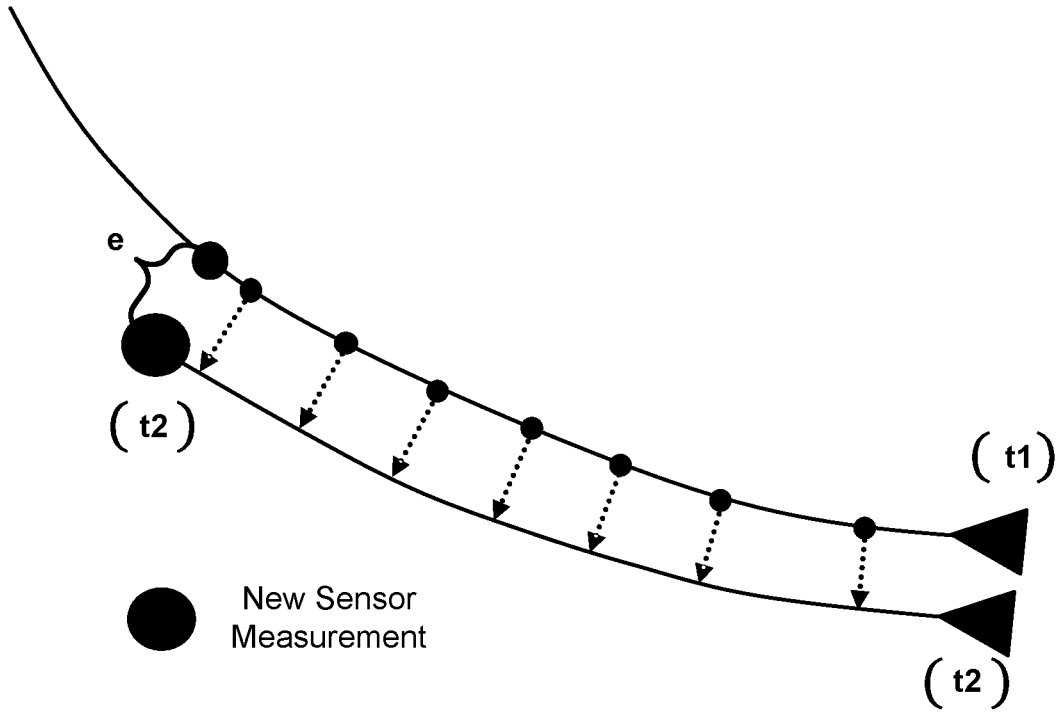
FIG. 13 shows an example of a method.

FIG. 13 shows an example of a method 1300 that may be implemented by a framework for performing corrections to one or more measurements. For example, as explained, a drillstring may be tripped-in (run in hole (RIH)) and tripped-out (pulled out of hole (POOH)) multiple times during drilling operations. Hence, one or more sensors may pass a point or points in a borehole multiple times such that multiple measurements are available for one or more points in the borehole. As an example, the method 1300 may include retrieving sensor depth estimated states, computing errors, updating sensor depth estimated values based on new measurements, and predicting states, for example, up to the drill bit depth. As shown in FIG. 13, an error (e) may be computed for an old measurement (e.g., at t1) and/or an old prediction (e.g., associated with t1) with respect to a new measurement (e.g., at t2). In such an example, the new measurement may be considered to be more accurate than the old measurement and/or old prediction and/or to be an additional measurement for purposes of averaging. In the example, of FIG. 13, the error (e) at the particular trajectory position may be propagated from that trajectory position forward to the HB, which may be a drill bit depth. In such an example, the method 1300 may provide for updating a prediction, which, as explained, may be a projection of one or more points of where a drill bit may drill a trajectory in a formation at a future time or future times. In such an example, the one or more points may be projected HB points.

As an example, the method 1300 may be utilized for a drillstring that includes one or more sensors at different distances from a drill bit of the drillstring. As explained, an RSS sensor group may be the first to be at a point during drilling of a borehole where one or more sensors of a MWD unit may be next to be at the point where drilling has progressed to extend the depth of the borehole by the distance between the RSS sensor group and the MWD unit. In such an example, measurements of the RSS sensor group may be at a time t1 while measurements of the MWD unit may be at a time t2, where such later acquired measurements may be utilized to make one or more adjustments to one or more HBEs and/or projections. As explained, during RIH or POOH, a sensor or sensor group may pass a point or points where measurements were previously acquired. In such an example, measurements may be for different times (e.g., t1, t2, t3, . . . tN). After a borehole has been completely drilled, a final POOH operation may be performed where acquired measurements may be utilized to generate a final set of HBEs. As an example, a framework may adjust HBEs one or more times, which may make a workflow dynamic and responsive to various aspects of directional drilling.

As explained, once drilled, a path in space and orientation of a borehole does not change (e.g., unless a collapse, subsidence, an earthquake, etc., occurs). However, by moving equipment into and out of the borehole, opportunities exist for acquiring additional data, which may be acquired during operations that do not involve actual drilling (e.g., breaking rock with a drill bit). As an example, a framework may provide for concatenation, fusion, etc., of data, which may occur in an online and/or an offline manner to get the best HBE values for a borehole. For example, for purposes of real-time online control, particular measurements as acquired during directional drilling that breaks rock with a drill bit may be used, optionally along with one or more static surveys where drilling is temporarily halted. As to a post-drilling process, a database of various measurements that may be acquired during drilling, during tripping, etc., may be accessed to select and process the selected measurements to arrive at more accurate HBE values for a drilled borehole.

As an example, during drilling, an RSS sensor group, if present, may be the first sensors to pass a point where, upon further drilling, one or more sensors of a MWD unit may pass that same point. In such an example, the MWD unit measurements are delayed in time but may be utilized to update one or more prior HBEs, which may be based on measurements solely from an RSS sensor group. In such an example, opportunities exist to compare and/or otherwise assess measurements, which may provide for assessing one or more sensors, for example, as to operational condition, uncertainty, etc. As an example, where an MWD unit passes a point measured by an RSS group of sensors, one or more uncertainties may be updated based at least in part on measurements from the MWD unit. In such an example, an uncertainty as to an HBE may be updated while the inclination and azimuth at a particular measured depth of the HBE may remain unchanged. In such a manner, information that may have been used to control drilling may be preserved while uncertainty as to that information may be updated (e.g., with a delay in time).

As explained, during directional drilling, opportunities exist to acquire multiple measurements at a point or points along a borehole. As an example, a multiple measurement approach may provide for assessments that may be utilized to trigger a mode change. For example, consider measurements being compared to determine whether or not a sensor or sensors are operating properly. In such an example, if one or more sensors are not operating properly, a mode of operation (e.g., HBE process) may be adjusted to not use one or more of such sensors. As explained, a blind mode and/or one or more other modes may be operated as background processes where, for example, one or more comparisons may be made between a selected mode of HBE and the one or more background modes of HBE. As an example, a blind mode or another mode that relies on fewer measurements than a full mode may be continually assessed and/or optionally updated to improve accuracy based on HBEs of a fuller mode.

As an example, a framework may include assessing sensors and their measurements, which may provide for inclusion and/or exclusion of such measurements in performing HBE. Such an approach may operate using one or more criteria, which may be related to one or more portions of a planned trajectory. For example, where a risk of collision may be higher, measurements from one or more questionable sensors may be excluded; whereas, where risks are lower, such measurements may be included in an HBE. As explained, a framework may provide for quantifying uncertainty, which may be for measurements from one or more sensors and/or for HBEs. As an example, a framework may provide for quantifying uncertainty based on one or more factors, which may include drillstring and formation interactions (e.g., frictional forces, vibrations, shocks, etc.), temperatures, pressures, etc.

Figure 14:
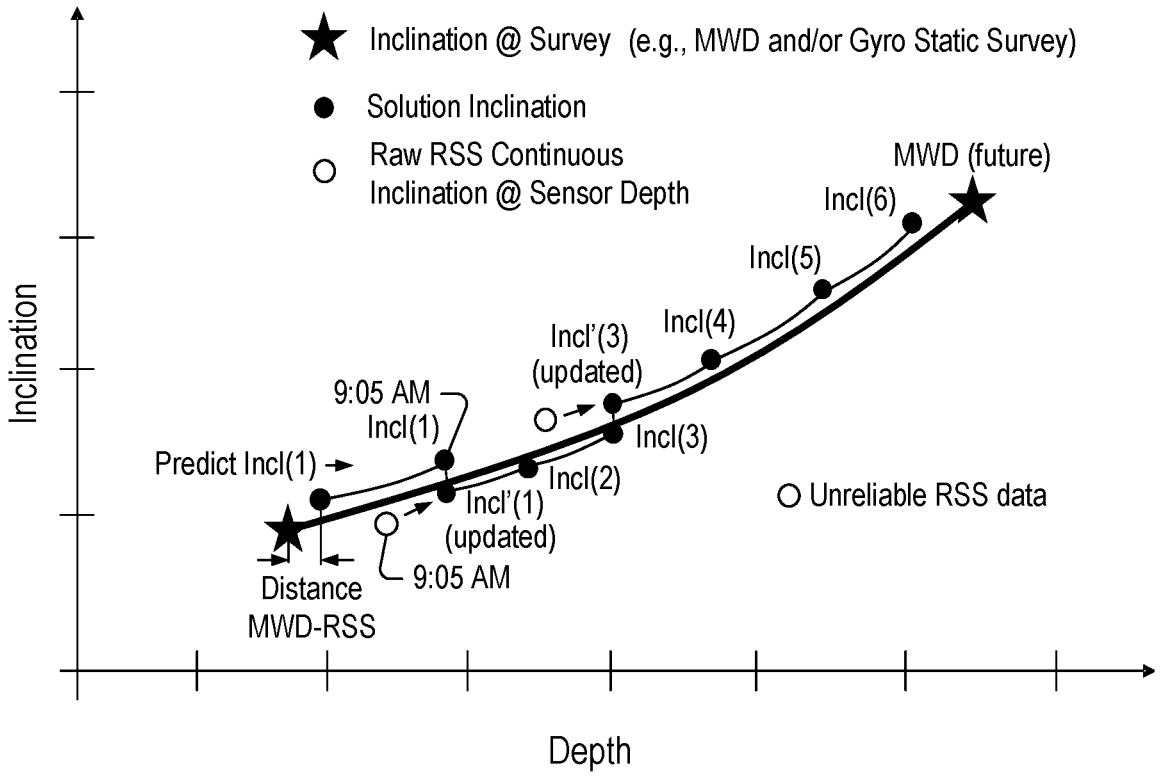
FIG. 14 shows an example of a method.

FIG. 14 shows an example of an estimation process 1400 through a plot of inclination versus depth for inclination survey measurements, at two depths, a series of solution inclinations at seven depths as predicted at various points in time, and three raw RSS continuous inclinations at corresponding sensor depths at various points in time. While the example of FIG. 14 shows inclination, one or more other characteristics may be utilized (e.g., azimuth, etc.). In the example of FIG. 14, the depth distance is not necessarily at scale and primarily for purposes of illustration. As shown, at a particular depth, at a time of 9:05 AM, the solution inclination at that depth (Incl(1)) may be updated (Incl'(1)) based on a raw RSS inclination measurement that is at a depth that is between two of the solution inclinations but at a common time (e.g., approximately 9:05 AM). In such an example, the raw RSS inclination measurement may be assessed with respect to one or more criteria to determine whether it is reliable and suitable for use in updating a predicted depth. For example, another one of the raw RSS inclination measurements is considered reliable whereas yet another one of the raw RSS inclination measurements is not considered reliable and hence not utilized to update a solution inclination.

In the example of FIG. 14, from left to right, a MWD static survey point is provided from an MWD tool (e.g., and/or a gyroscope tool) and a known distance between the MWD tool and an RSS tool (e.g., MWD tool to bit distance). Given the MWD tool and the RSS tool position, a future inclination may be predicted (see Incl(1)). However, where RSS tool data become available, the predicted inclination may be updated (see Incl'(1)). In the example of FIG. 14, the thick curve that connects the two MWD static survey points is not known a priori because the leftmost MWD point is not yet known. As such, the predictions are based on prior predictions and, where available, RSS tool data (e.g., which may include gyroscope sensor data). Once the leftmost MWD point does become available, some amount of smoothing may be performed to account for actual physical constraints of a physical drillstring in a physical borehole (e.g., each without kinks). In the example of FIG. 14, the MWD static survey points may be taken as reliable points, which, as explained, may be acquired when drilling has been halted.

Figure 15:
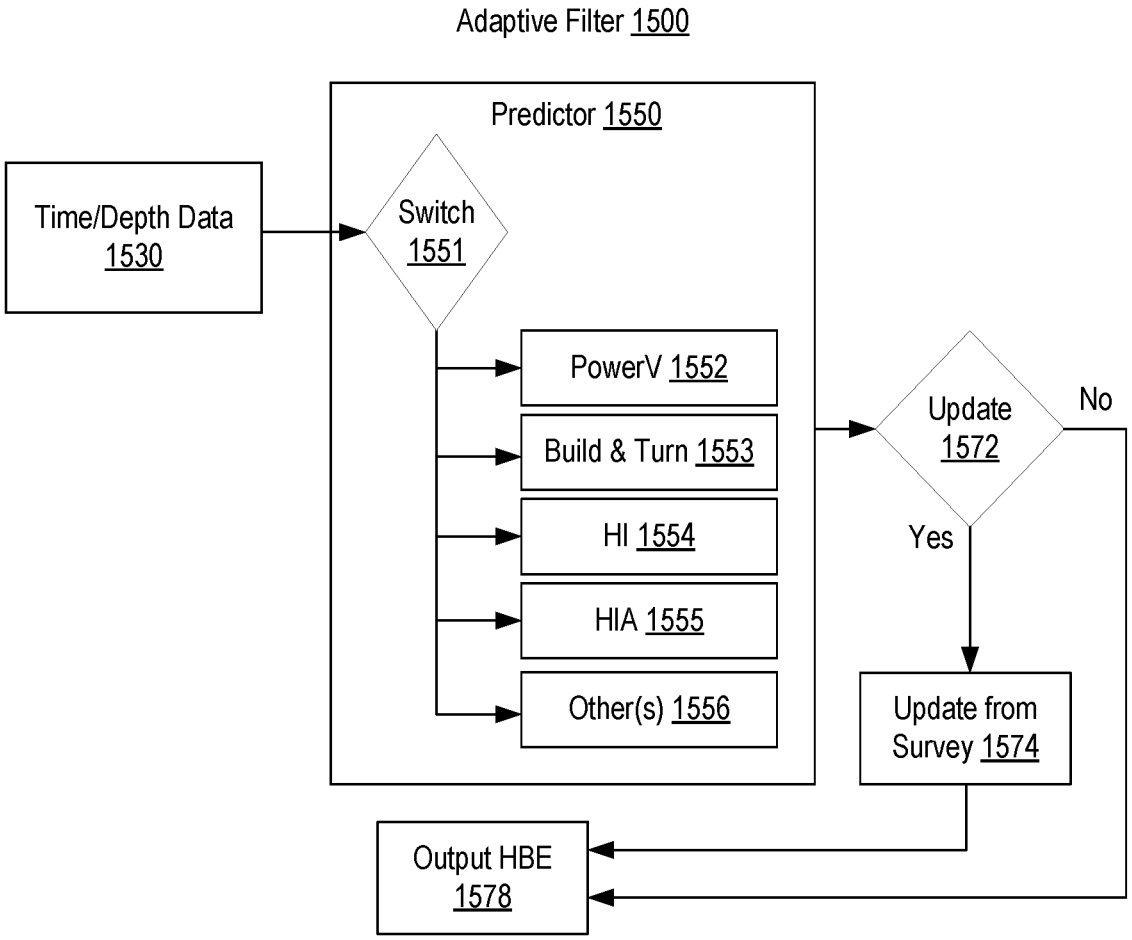
FIG. 15 shows an example of an adaptive filter and predictor.

FIG. 15 shows an example of an adaptive filter 1500 that may be part of a framework. As shown, the adaptive filter 1500 may include a predictor 1550 that may receive time and/or depth data per an input block 1530 and may output one or more HBEs per an output block 1578. In the example of FIG. 15, the predictor 1550 may include a switch 1551 that may automatically select one of a plurality of different models that correspond to different modes of operation for directional drilling operations (e.g., different drilling mode models). For example, the models may include a PowerV model 1552, a build and turn model 1553, an HI model 1554, an HIA model 1555, and one or more other models 1556. As shown, the predictor 1550 may proceed to an update decision block 1572 that may decide whether an output of the predictor 1550, which may be an HBE, is to be updated, for example, from a survey. As shown, a "yes" branch for updating output from the predictor 1550 may proceed to an update block 1574 for updating a prediction (e.g., HBE) using survey data; whereas, a "no" branch may proceed to the output block 1578 for outputting an HBE.

In the example of FIG. 15, the predictor 1550 may include different models that have been created for each drilling mode. The predictor 1550 may operate the switch 1551 based on one or more selection criteria of a model based on drilling mode. As an example, while drilling, the current mode may be known, therefore, this information may be received and utilized by the predictor 1550 for selection of the appropriate model for generating an HBE. As shown in the example of FIG. 15, if new downhole information is received, this may be relevant to the decision block 1572 as to whether or not an update process will be triggered to adjust the HBE of the predictor 1550, for example, starting from a last known static survey. As explained, an HBE may include drill bit or HB position including depth, azimuth angle and inclination angle along with, for example, estimated variances. As explained, a framework may operate in one or more modes, which may include a blind mode and one or more non-blind modes. As explained, for a blind mode, or during a lost or unstable downhole signals, a process may be able to generate a best HBE.

As mentioned, an estimation process may include filtering or not filtering. As mentioned, an estimation process may utilize a linear regression filter, a piecewise linear with changes in steering settings, a multi-variate piecewise linear filter, a multi-variate piecewise linear filter with uncertainties, one or more types of Kalman filters (e.g., extended Kalman filter, unscented Kalman filter, etc.), a particle filter, a basic median filter, a Gaussian process-based filter, etc.

As an example, a framework may utilize one or more types of models, which may be or include one or more types of recursive models, machine learning (ML) models, combinations of types of models, etc. For example, consider a data-driven Kalman filter as a model that is an efficient recursive filter that may be utilized for estimating a state of a dynamic system from a series of measurements, which may have associated uncertainty. As an example, a Kalman filter model may be implemented as an optimal online learning technique for a system that may include noise (e.g., Gaussian, etc.). As an example, a model may be a predictive model that may receive input and generate output as predicted output. While a Kalman filter model is mentioned, one or more other types of models may be utilized, additionally or alternatively. For example, consider a neural network model as a type of ML model. As an example, a model may include one or more recursive features and/or one or more recurrent features. A recurrent neural network (RNN) may be implemented as a model, by a framework, to process sequential data (e.g., time series and/or depth series) to generate output (e.g., HBEs). An RNN may include structures such as long short-term memory (LSTM). An RNN may include connections between nodes that may create a cycle, allowing output from some nodes to affect subsequent input to the same nodes. Such a structure may allow an RNN to exhibit temporal dynamic behavior. Derived from feedforward neural networks, RNNs may use their internal state (e.g., memory) to process variable length sequences of inputs.

As explained, various types of filters may include a prediction-correction type of architecture where prediction may utilize one or more types of models (e.g., predictive models, etc.). As an example, a filter may provide for a prediction of a future system state based on past estimations. As an example, a filter may provide for one or more predictions that may closely resemble what one or more measurements should be without or with lesser uncertainty than one or more corresponding actual measurements. As explained, actual measurements (e.g., sensor data, sensor data-based results, etc.) may include uncertainties due to one or more factors (e.g., sensor mechanics and/or electronics, temperature, vibration, shock, etc.).

As an example, a filter-based approach may aim to improve sensor data-based results. For example, sensor data may include uncertainties due to one or more factors such that sensor data-based results also include uncertainties. As an example, a filter-based approach may provide for effective smoothing, which may be based on use of a model such as, for example, a predictive model. As an example, an optimal state estimate may be based in part on a predicted state estimate and sensor data. As an example, in a prediction-correction architecture, sensor data may provide for corrections that may benefit optimal state estimation. As an example, in various instances, a correction may be considered an update that may be based on sensor data. As an example, a filter may operate by making a state vector prediction, a covariance prediction, a gain computation and by receiving sensor data to make a state estimate update and a covariance update. In such an example, a result may be an estimated state along with covariance of the estimated state (e.g., uncertainty, etc.).

In the example of FIG. 15, the predictor 1550 may include one or more types of features for making predictions, which may include features for making predictions and corrections. As explained, a prediction may be model-based where a model may be a physics-based model, a data-driven model (e.g., an ML model), a hybrid model (e.g., physics and data-driven), etc. As explained, drilling may be performed using various modes. As an example, such modes may be modeled using one or more types of models. For example, a model for a sliding mode may differ from a model for a rotating mode where one or more differences may depend on control, operation, parameters, equipment, interactions between equipment and rock and/or fluid, etc. As to the aforementioned prediction-correction architecture, a prediction portion and/or a correction portion may depend on mode. For example, as mentioned, a correction may depend on sensor data where, for example, a particular mode may provide particular sensor data that may differ in one or more aspects from sensor data of another mode.

As an example, a model or models may depend on parameters such as, for example, one or more of walk rate (WR), build rate (BR), yield (Y), toolface (TF), ROP, etc. As an example, parameters may include one or more tendency parameters, one or more steering ratio parameters, one or more toolface parameters, etc. As explained, models may differ for different modes. As an example, parameters may differ for different models. As an example, one or more models may provide for computing an estimated change in orientation (e.g., inclination and/or azimuth).

As an example, gyroscope sensor data may be utilized where such data may improve determinations as to orientation. For example, gyroscope sensor data (e.g., consider GYROSPHERE tool data, etc.) may provide for more precise azimuth mapping, which makes orientation of a HBE more precise. As an example, gyroscope sensor data may help to reduce uncertainty of orientation (e.g., reduced uncertainty of azimuth, etc.).

In the example of FIG. 15, the adaptive filter 1500 may operate in a robust manner that facilitates automation. For example, the adaptive filter 1500 may operate to detect a mode of operation automatically followed by automatic selection of an appropriate model (e.g., filter) for the detected mode. Such an approach may reduce demand for human involvement (e.g., demand a human-in-the-loop (HITL)). Such an approach may also operate robustly and more objectively than a human, for example, by making more consistent and time decisions as to model to be utilized. As an example, the adaptive filter 1500 may receive time and/or depth data per the input block 1530 where such data may be processed, for example, for outlier removal, for harmonization, etc.

In the example of FIG. 15, the predictor 1550 may also include one or more models for mud motor types of drillstrings for modes such as, for example, sliding and rotating. In the example of FIG. 15, each of the models may be trained, configured, etc., to a particular mode. For example, consider training one or more ML models using data acquired during one or more modes. In such an example, the HI model 1554 may be trained using data acquired during HI directional drilling. As explained, the adaptive filter 1500 of FIG. 15 may be part of a larger system or framework that may provide for one or more levels of autonomous directional drilling.

As an example, a framework may utilize one or more inference techniques to determine a mode. For example, consider receipt of downhole data and surface data by a framework where the framework may detect a steering mode for directional drilling. In such an example, the model may detect whether a mud motor equipped drillstring is in a sliding mode or a rotating mode. Similarly, where a drillstring includes an RSS, the framework may detect a current RSS mode. As an example, directional drilling may operate according to a digital plan to drill a number of stands in a particular mode. In such an example, a framework may be able to confirm the mode and, if not confirmed, perform HBE using the detected mode. Such an approach may provide for enhanced oversight of automation to assure that the mode that is actually being utilized may be confirmed and, for purposes of HBE, the appropriate model utilized by a framework to assure that the predicted HBEs are accurate.

As an example, a blind mode may utilize one or more types of ML models. As explained, a blind mode may operate where certain data are unavailable. As an example, for each mode of a predictor, there may be a blind mode model and a non-blind mode model. As explained, where a drillstring includes an RSS (e.g., an RSS tool), if data are unavailable and/or unreliable (e.g., too high in uncertainty, etc.) for the RSS, then a blind mode may be implemented. As explained, a blind mode may operate as a background mode, optionally using one or more types of available information such as, for example, information from a surface listener. As explained, inferences may be made as to state of an RSS using information from a surface listener. As an example, such inferences may be made using one or more ML models. In such an example, where inferences are made as part of a background process, some information may be available for purposes of labeling, confirming, etc., such that ML model training and/or testing may be improved. For example, consider utilizing information from a surface listener and information from uplinks of an RSS, where available, to improve ML model training and/or testing such that an improved ML model may be implemented as desired, which may be in a blind mode where uplinks of an RSS are not available or uncertain (e.g., unreliable).

Figure 16:
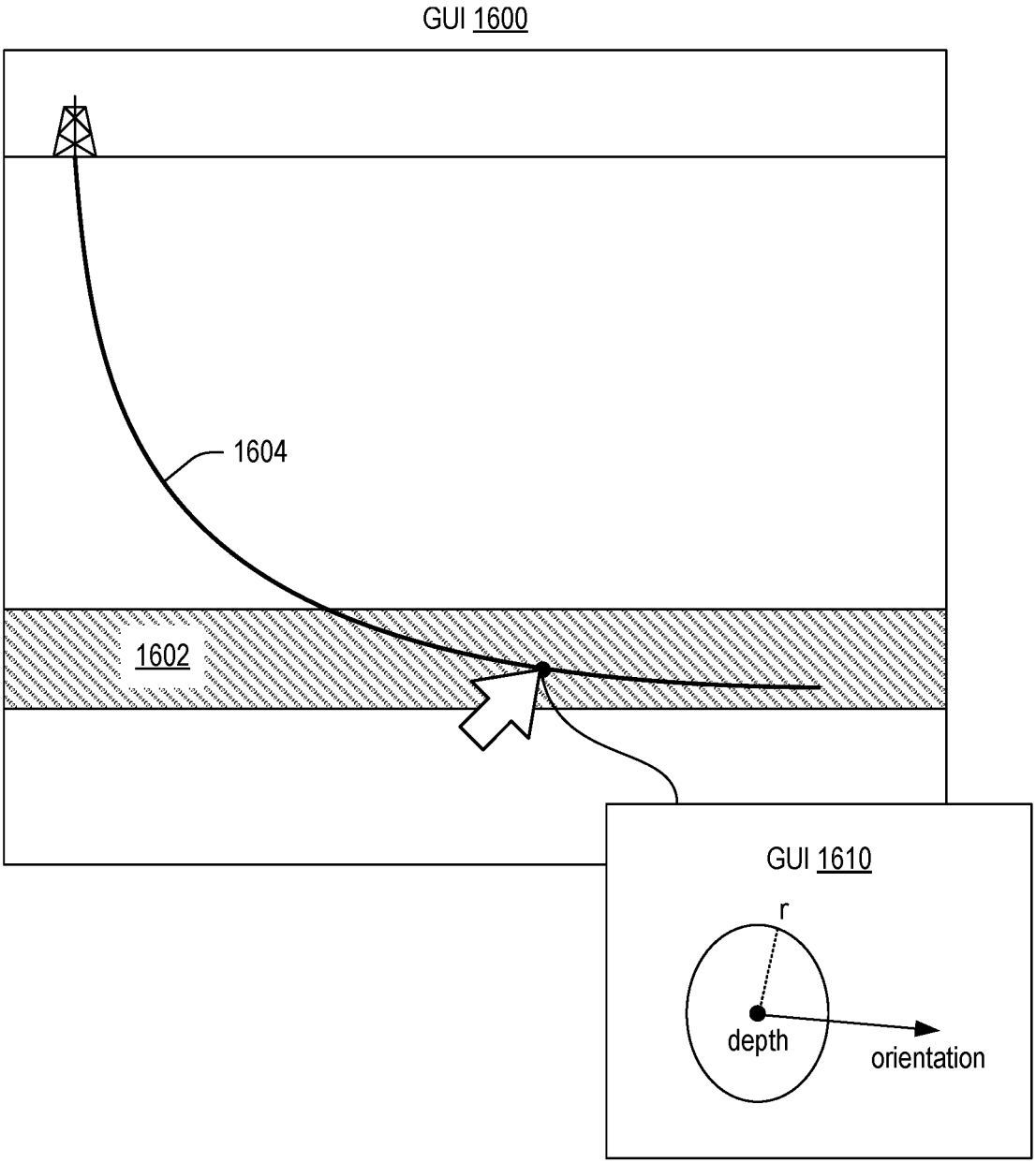
FIG. 16 shows an example of a graphical user interface.

FIG. 16 shows an example of a graphical user interface (GUI) 1600 that may be rendered to a display for interactions with a human machine interface (HMI). In the example of FIG. 16, the GUI 1600 shows a reservoir layer 1602 and a trajectory 1604 where, for example, a cursor may be positioned at a selected point on the trajectory 1604 such that depth and orientation of the trajectory 1604 may be rendered. For example, consider an example GUI 1610 that may show a representation of the trajectory, which may have been generated as a BHE, along with depth and orientation (e.g., inclination and azimuth). As explained, a system may provide for maintaining a proper reference as drilling operations progress to ultimately directionally drill a borehole to a desired target or targets. The GUI 1600 may be associated with a data structure for the trajectory 1604, where the data structure includes information as to position and orientation of the trajectory 1604 at various points, which may be relatively continuous (e.g., via smoothing, etc.).

Figure 17:
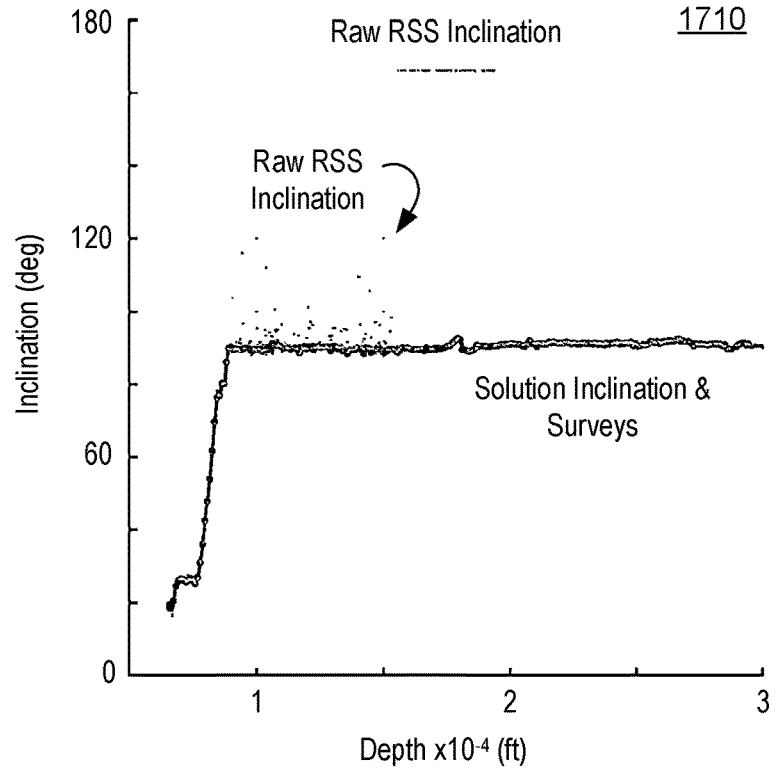
FIG. 17 shows examples of plots of hole bottom characteristics.
Figure 17:
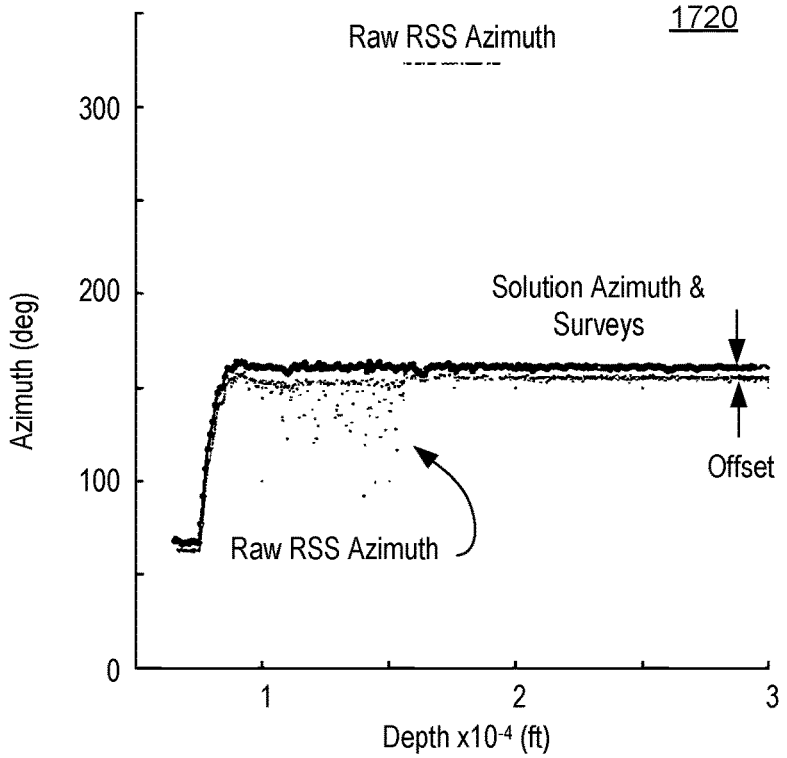

FIG. 17 shows example plots 1710 and 1720 of inclination versus measured depth and azimuth versus measured depth, respectively. In each of the plots 1710 and 1720, respective solutions are shown as outputs of a framework that may perform HB estimation where the HBEs are substantially overlying survey points (see dots overlying circles). Further, raw RSS inclination is shown in the plot 1710 and raw RSS azimuth is shown in the plot 1720. As to these raw RSS values as acquired by an RSS sensor group, varied deviations are shown at lower depths (e.g., 10,000 ft to 15,000 ft) followed by substantially constant and sporadic outliers over a subsequent depth range (e.g., 15,000 ft to 20,000 ft). As an example, such values may be assessed according to one or more criteria and deemed unreliable such that they are not utilized in updating predictions (e.g., HBEs).

Further, in the plot 1720, an offset is shown between values, which may be an azimuth offset that may be taken into account. As shown, the azimuth offset remains relatively constant over depths from approximately 15,000 ft to approximately 30,000 ft.

As explained, surveys may be static surveys that may be performed, for example, during a time when drilling is temporarily halted for adding a stand (e.g., one or more lengths of drillpipe) or at another time when drilling is temporarily halted. As to stands, each stand may be two or three single joints of drillpipe or drill collars that may be added during drilling operations to extend a borehole. As an example, a single joint of drillpipe may be approximately 9.6 m in length (e.g., approximately 31.6 ft in length) such that a static survey for a stand may be taken at approximately 20 m to approximately 30 m intervals. As an example, if uncertainty exists as to position of a drill bit, drilling may be halted to perform a static survey.

In the example plots 1710 and 1720, the raw RSS values may indicate one or more issues as to measurements from the RSS sensor group (e.g., noise, offset, etc.). As shown, solution values for inclination and azimuth as generated by a framework may be acceptably accurate without the RSS measurements. As explained, one or more criteria may be utilized to exclude one or more types of measurements, which may be or include, for example, RSS measurements. In such an approach, noisy measurements may be excluded.

In the example plots 1710 and 1720, where offset does exist, it may be flagged and/or tracked. For example, in the plot 1720, the azimuth offset may be computed by a framework where the azimuth offset may be an indicator of one or more issues and/or may be utilized to adjust measurements for the presence of the offset. As explained, an RSS sensor group may generate measurements as to offset to tool bottom (e.g., to drill bit), however, azimuth as measured may itself have an offset, which may be adjusted as discussed with respect to the offset in the plot 1720. As an example, an offset may occur in inclination and referred to as an inclination offset; however, in general, an inclination offset tends to be relatively small and smaller than an azimuth offset.

As to a final set of values, a framework may perform smoothing such that values for a drilled borehole are consistent, for example, with respect to one or more types of continuity metrics. For example, consider use of one or more parametric continuity metrics such as C0, C1, C2, etc. As to C0, it means that the zeroth derivative is continuous (curves are continuous). As to C1, it means that the zeroth and first derivatives are continuous. As to C2, it means that the zeroth, first and second derivatives are continuous. As to Cn, it means that the zeroth to the n-th derivatives are continuous. Smoothing may be appropriate particularly as a borehole is formed using a drillstring which is a continuous string of equipment with equipment properties and shapes that do not provide for sharp bends; noting that a mud motor may include a bend that may be somewhat sharp (e.g., discontinuous at one or more derivatives) compared to a curvature achievable by the drillstring. As an example, smoothing may smooth HB depths and HB orientations. As an example, one or more interpolation techniques may be utilized for purposes of smoothing, etc. As an example, a minimum curvature interpolation technique may be employed.

As an example, a framework may provide for estimating the position of a HB in terms of inclination and azimuth, for example, using one or more optimal and adaptive filtering techniques with uncertainties available as output.

As an example, a framework may provide for estimating a HB by combining RSS continuous data measurements, MWD continuous data measurements, survey measurements and one or more types of additional downhole D&I measurement and/or surface information.

As an example, a framework may provide for estimating HB while drilling with an RSS enabled drillstring.

As an example, a framework may provide for estimating HB while drilling with a mud motor as a steerable tool.

As an example, a framework may provide for estimating the HB that may also interpolate trajectory of a wellbore at a given depth between the surface and the current HB position.

As an example, a framework may provide for estimating the HB that may also extrapolate the trajectory of a wellbore at a given depth between from the current hole bottom position to one or more next targets or beyond.

As an example, a framework may provide for estimating the HB that may handle sensor output outliers while still generating accurate predictions of HB.

As an example, a framework may provide for estimating the HB in a manner that is able to operate even when there is loss of communication from an RSS of a drillstring.

As an example, a framework may provide for estimating the HB even when drilling substantially parallel to a zone of exclusion.

As an example, a framework may provide for obtaining a high-definition wellbore trajectory, which may be part of a post-drilling process (e.g., post-processing). As explained, after a section of a well is drilled, various types of data, as may be acquired at various times and/or depths, may be utilized to generate the best HBEs, which may then be associated with a digital file for the well. In such an example, the digital file may be utilized for one or more purposes, which may include completions, injecting, producing, stimulation, anti-collision for one or more other wells to be drilled, etc.

As an example, a framework may generate a high-definition borehole trajectory that may be used for one or more purposes such as, for example, to derive accurate 3D positioning that includes a more accurate TVD estimate, more accurate N/S estimate (northing estimate) and/or more accurate E/W estimate (easting estimate). Such an approach may be particularly useful in the context of geosteering where, as explained, directional drilling within a reservoir layer may pose particular challenges.

Figure 18:
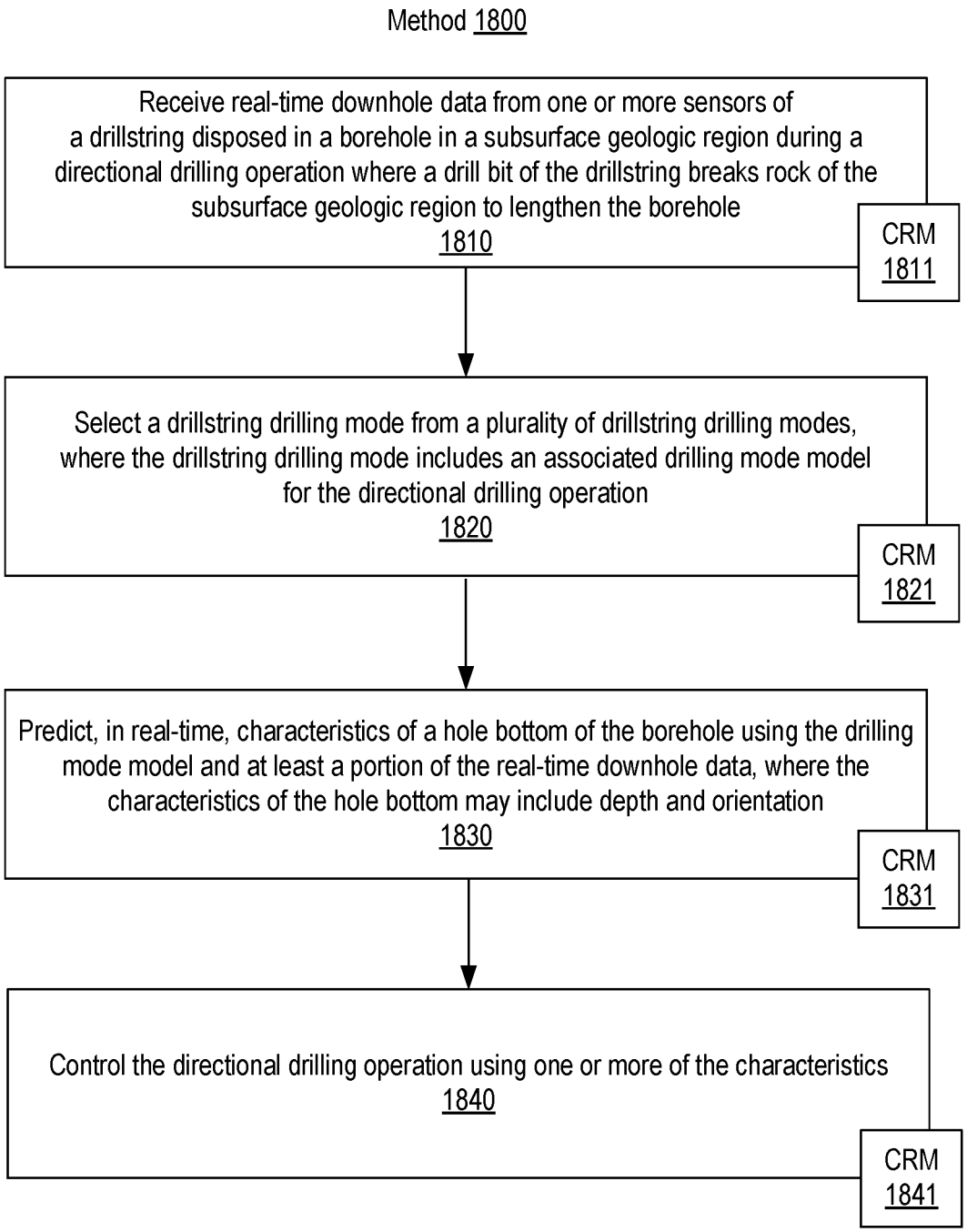
FIG. 18 shows an example of a method.

FIG. 18 shows an example of a method 1800 that may include a reception block 1810 for receiving real-time downhole data from one or more sensors of a drillstring disposed in a borehole in a subsurface geologic region during a directional drilling operation where a drill bit of the drillstring breaks rock of the subsurface geologic region to lengthen the borehole; a selection block 1820 for selecting a drillstring drilling mode from a plurality of drillstring drilling modes, where the drillstring drilling mode includes an associated drilling mode model for the directional drilling operation; a prediction block 1830 for predicting, in real-time, characteristics of a hole bottom of the borehole using the drilling mode model and at least a portion of the real-time downhole data, where, for example, the characteristics of the hole bottom may include depth and orientation; and a control block 1840 for controlling the directional drilling operation using one or more of the characteristics.

As shown in FIG. 18, the method 1800 may be implemented via one or more computer-readable media (CRM) per blocks 1811, 1821, 1831 and 1841, which may, for example, be implemented using a system such as a computing system (see, e.g., the example system 300 of FIG. 3, the example system 770 of FIG. 7, etc.). Such blocks may include processor-executable instructions.

As explained, various systems, methods, etc., may implement one or more ML models. As to types of ML models, consider one or more of a support vector machine (SVM) model, a k-nearest neighbors (KNN) model, an ensemble classifier model, a neural network (NN) model, incremental learning, Q-learning, etc. As an example, a machine learning model may be a deep learning model (e.g., deep Boltzmann machine, deep belief network, convolutional neural network, stacked auto-encoder, etc.), an ensemble model (e.g., random forest, gradient boosting machine, bootstrapped aggregation, AdaBoost, stacked generalization, gradient boosted regression tree, etc.), a neural network model (e.g., radial basis function network, perceptron, back-propagation, Hopfield network, etc.), a regularization model (e.g., ridge regression, least absolute shrinkage and selection operator, elastic net, least angle regression), a rule system model (e.g., cubist, one rule, zero rule, repeated incremental pruning to produce error reduction), a regression model (e.g., linear regression, ordinary least squares regression, stepwise regression, multivariate adaptive regression splines, locally estimated scatterplot smoothing, logistic regression, etc.), a Bayesian model (e.g., naïve Bayes, average on-dependence estimators, Bayesian belief network, Gaussian naïve Bayes, multinomial naïve Bayes, Bayesian network), a decision tree model (e.g., classification and regression tree, iterative dichotomiser 3, C4.5, C5.0, chi-squared automatic interaction detection, decision stump, conditional decision tree, M5), a dimensionality reduction model (e.g., principal component analysis, partial least squares regression, Sammon mapping, multidimensional scaling, projection pursuit, principal component regression, partial least squares discriminant analysis, mixture discriminant analysis, quadratic discriminant analysis, regularized discriminant analysis, flexible discriminant analysis, linear discriminant analysis, etc.), an instance model (e.g., k-nearest neighbor, learning vector quantization, self-organizing map, locally weighted learning, etc.), a clustering model (e.g., k-means, k-medians, expectation maximization, hierarchical clustering, etc.), etc.

As an example, a system may utilize one or more recurrent neural networks (RNNs). One type of RNN is referred to as long short-term memory (LSTM), which may be a unit or component (e.g., of one or more units) that may be in a layer or layers. A LSTM component may be a type of artificial neural network (ANN) designed to recognize patterns in sequences of data, such as time series data. When provided with time series data, LSTMs take time and sequence into account such that an LSTM may include a temporal dimension. For example, consider utilization of one or more RNNs for processing temporal data from one or more sources, optionally in combination with spatial data. Such an approach may recognize temporal patterns, which may be utilized for making predictions (e.g., as to a pattern or patterns for future times, etc.).

As an example, the TENSORFLOW framework (Google LLC, Mountain View, California) may be implemented, which is an open-source software library for dataflow programming that includes a symbolic math library, which may be implemented for machine learning applications that may include neural networks. As an example, the CAFFE framework may be implemented, which is a DL framework developed by Berkeley AI Research (BAIR) (University of California, Berkeley, California). As another example, consider the SCIKIT platform (e.g., scikit-learn), which utilizes the PYTHON programming language. As an example, a framework such as the APOLLO AI framework may be utilized (APOLLO.AI GmbH, Germany). As mentioned, a framework such as the PYTORCH framework may be utilized.

As an example, a training method may include various actions that may operate on a dataset to train a ML model. As an example, a dataset may be split into training data and test data where test data may provide for evaluation. A method may include cross-validation of parameters and best parameters, which may be provided for model training.

The TENSORFLOW framework may run on multiple CPUs and GPUs (with optional CUDA (NVIDIA Corp., Santa Clara, California) and SYCL (The Khronos Group Inc., Beaverton, Oregon) extensions for general-purpose computing on graphics processing units (GPUs)). TENSORFLOW is available on 64-bit LINUX, MACOS (Apple Inc., Cupertino, California), WINDOWS (Microsoft Corp., Redmond, Washington), and mobile computing platforms including ANDROID (Google LLC, Mountain View, California) and IOS (Apple Inc.) operating system-based platforms.

TENSORFLOW computations may be expressed as stateful dataflow graphs; noting that the name TENSORFLOW derives from the operations that such neural networks perform on multidimensional data arrays. Such arrays may be referred to as "tensors".

As an example, an ML model may be run online using cloud computation resources followed by an on-target well delivery approach that may automatically feed data to the ML model, which may be updated at a given frequency. As an example, a ML model may be run in an offline manner where a result or results may be transmitted to a planning workflow.

As an example, a method may include receiving real-time downhole data from one or more sensors of a drillstring disposed in a borehole in a subsurface geologic region during a directional drilling operation, where a drill bit of the drillstring breaks rock of the subsurface geologic region to lengthen the borehole; selecting a drillstring drilling mode from a plurality of drillstring drilling modes, where the drillstring drilling mode includes an associated drilling mode model for the directional drilling operation; predicting, in real-time, characteristics of a hole bottom of the borehole using the drilling mode model and at least a portion of the real-time downhole data; and controlling the directional drilling operation using one or more of the characteristics.

In such an example, the characteristics of the hole bottom may include depth and orientation, where, for example, the depth includes measured depth and the orientation includes inclination and azimuth.

As an example, a drilling mode model for a directional drilling operation may include one or more machine learning models. As an example, a drilling mode model may be a filter that includes one or more machine learning models.

As an example, a method may include controlling that may include adjusting an orientation of a drill bit of a drillstring to drill to a target position in a subsurface geologic region.

As an example, one or more sensors of a drillstring may include one or more measurement while drilling (MWD) sensors and/or one or more rotary-steerable system (RSS) sensors.

As an example, one or more sensors of a drillstring may include one or more micro-electromechanical system gyroscope sensors that generate gyroscope sensor data that may increase accuracy of orientation predictions of hole bottoms of a borehole. As explained, a series of hole bottom predictions (e.g., estimations) may be utilized to form a model of a borehole where depth and orientation characteristics of the borehole. As an example, such a model of a borehole may be utilized for one or more purposes, which may include, for example, planning one or more wells, performing an anti-collision process (e.g., during planning, drilling, etc.), etc.

As an example, a drillstring may include a mud motor and may not include a rotary-steerable system (RSS), where a plurality of drillstring drilling modes may include a sliding mode and a rotating mode.

As an example, a method may include controlling that may control geosteering. For example, consider geosteering that may maintain a drill bit of a drillstring within a reservoir layer defined in part by an upper depth (e.g., a roof) and a lower depth (e.g., a floor). As an example, a layer may be defined by interfaces or boundaries where, for example, a reservoir layer may exist between two other layers where the reservoir layer has an interface or boundary with one of the layers and an interface or boundary with the other of the layers. As an example, a reservoir layer may include fluid such as, for example, hydrocarbon fluid.

As an example, a method may include estimating true vertical depth based at least in part on one or more of characteristics of a hole bottom.

As an example, a method may include estimating one or more of northing and easting based at least in part on one or more of characteristics of a hole bottom.

As an example, a plurality of drillstring drilling modes may include one or more hold inclination modes. As an example, such hold inclination modes may be modeled using one or more models.

As an example, a method may include receiving real-time static survey data acquired during a time period where a directional drilling operation may be halted. As explained, directional drilling may include adding drillpipe to a drillstring where a connection is made between a drillpipe and the drillstring. During a connection, a directional drilling operation may be halted. For example, a direction drilling operation where a drill bit of a drillstring breaks rock to lengthen a borehole may be halted. As explained, one or more types of static surveys may be performed when a directional drilling operation is halted.

As an example, a method may include predicting that may include predicting at least one characteristic for a future hole bottom of the borehole. In such an example, consider, at an actual time of creation of the future hole bottom, receiving additional real-time downhole data and updating predicting of the at least one characteristic based at least in part on the additional real-time downhole data.

As an example, a method may include pulling a drillstring out of a borehole after performing a directional drilling operation and acquiring data during the pulling of the drillstring out of the borehole, where one or more characteristics may be adjusted to generate a set of characteristics of the borehole, where the adjusting utilizes at least a portion of the acquired data. As an example, such a method may include running the drillstring into the borehole after pulling the drillstring out of the borehole, acquiring data during the running of the drillstring into the borehole, and adjusting one or more of the characteristics to generate a revised set of the characteristics for the borehole.

As an example, a system may include one or more processors; memory accessible to at least one of the one or more processors; processor-executable instructions stored in the memory and executable to instruct the system to: receive real-time downhole data from one or more sensors of a drillstring disposed in a borehole in a subsurface geologic region during a directional drilling operation, where a drill bit of the drillstring breaks rock of the subsurface geologic region to lengthen the borehole; select a drillstring drilling mode from a plurality of drillstring drilling modes, where the drillstring drilling mode includes an associated drilling mode model for the directional drilling operation; predict, in real-time, characteristics of a hole bottom of the borehole using the drilling mode model and at least a portion of the real-time downhole data; and control the directional drilling operation using one or more of the characteristics.

As an example, one or more non-transitory computer-readable storage media may include processor-executable instructions to instruct a computing system to: receive real-time downhole data from one or more sensors of a drillstring disposed in a borehole in a subsurface geologic region during a directional drilling operation, where a drill bit of the drillstring breaks rock of the subsurface geologic region to lengthen the borehole; select a drillstring drilling mode from a plurality of drillstring drilling modes, where the drillstring drilling mode includes an associated drilling mode model for the directional drilling operation; predict, in real-time, characteristics of a hole bottom of the borehole using the drilling mode model and at least a portion of the real-time downhole data; and control the directional drilling operation using one or more of the characteristics.

As an example, a computer program product that may include computer-executable instructions to instruct a computing system to perform one or more methods such as one or more of the methods described herein (e.g., in part, in whole and/or in various combinations).

The embodiments disclosed in this disclosure are to help explain the concepts described herein. This description is not exhaustive and does not limit the claims to the precise embodiments disclosed. Modifications and variations from the exact embodiments in this disclosure may still be within the scope of the claims.

Likewise, the steps described need not be performed in the same sequence discussed or with the same degree of separation. Various steps may be omitted, repeated, combined, or divided, as appropriate. Accordingly, the present disclosure is not limited to the above-described embodiments, but instead is defined by the appended claims in light of their full scope of equivalents. In the above description and in the below claims, unless specified otherwise, the term "execute" and its variants are to be interpreted as pertaining to any operation of program code or instructions on a device, whether compiled, interpreted, or run using other techniques.

Certain of the claims below may include numbered lists. The numbers are provided as an organizational tool to aid in readability. The numbers themselves do not indicate an expected order of configuration or execution or otherwise have substantive meaning. For United States applications, the claims that follow do not invoke section 112(f) unless the phrase "means for" is expressly used together with an associated function.

What is claimed is:

1. A method comprising:

receiving real-time downhole data, via mud-pulse telemetry, acquired by one or more sensors of one or more tools of a drillstring disposed in a borehole in a subsurface geologic region during a directional drilling operation, wherein a drill bit of the drillstring breaks rock of the subsurface geologic region to lengthen the borehole, wherein the one or more tools comprise a measurement while drilling (MWD) tool and a rotary steerable system (RSS) tool, and wherein the drillstring comprises a mud-pulse telemetry unit and MWD tool and RSS tool uplink circuitry;

identifying that an insufficient portion of the real-time downhole data is insufficient for use in a hole bottom estimation based at least in part on an operational issue of the MWD tool and the RSS tool uplink circuitry;

identifying an operational issue between the MWD tool and the RSS tool uplink circuitry, wherein the identification of the operational issue triggers an implementation of a blind mode, wherein the blind mode modifies the real-time downhole data to generate modified real-time downhole data, and wherein the modified real-time downhole data excludes measurements from the RSS tool;

inferring, using the modified real-time downhole data, an inferred state of the RSS tool;

based on the insufficient portion, implementing a blind mode for a drilling mode model used to estimate a hole bottom position of a hole bottom, wherein, in the blind mode, the drilling mode model excludes measurements from the RSS tool and includes the inferred state of the RSS tool;

estimating a hole bottom position of a hole bottom using a drilling mode model, the inferred state of the RSS tool, and the modified real-time downhole data generated from the blind mode;

predicting, in real-time, one or more characteristics of the hole bottom of the borehole using the drilling mode model in the blind mode and at least a portion of the modified real-time downhole data; and controlling the directional drilling operation using the blind mode for the drilling mode model and the one or more of the characteristics of the hole bottom of the borehole, wherein controlling the directional drilling operation includes adjusting an orientation of the drill bit from a first orientation to a second orientation.

2. The method of claim 1, wherein the characteristics of the hole bottom comprise depth and orientation, wherein the depth comprises measured depth and the orientation comprises inclination and azimuth.

3. The method of claim 1, wherein the drilling mode model for the directional drilling operation comprises a machine learning model.

4. The method of claim 1, wherein the controlling comprises adjusting an orientation of the drill bit of the drillstring to drill to a target position in the subsurface geologic region.

5. The method of claim 1, wherein the one or more sensors of the drillstring comprise one or more micro-electromechanical system gyroscope sensors that generate gyroscope sensor data that increase accuracy of orientation predictions of hole bottoms of the borehole.

6. The method of claim 1, wherein the plurality of drillstring drilling modes comprises a sliding mode and a rotating mode.

7. The method of claim 1, wherein the controlling controls geosteering.

8. The method of claim 7, wherein the geosteering maintains the drill bit of the drillstring within a reservoir layer defined in part by an upper depth and a lower depth.

9. The method of claim 1, comprising estimating true vertical depth based at least in part on one or more of the characteristics of the hole bottom.

10. The method of claim 1, comprising estimating one or more of northing and easting based at least in part on one or more of the characteristics of the hole bottom.

11. The method of claim 1, wherein the one or more hold inclination modes comprise a hold inclination mode and a hold inclination and azimuth mode.

12. The method of claim 1, comprising receiving real-time static survey data acquired during a time period wherein the directional drilling operation is halted.

13. The method of claim 1, wherein the predicting further comprises predicting at least one characteristic for a future hole bottom of the borehole.

14. The method of claim 13, comprising, at an actual time of creation of the future hole bottom, receiving additional real-time downhole data and updating the predicting of the at least one characteristic based at least in part on the additional real-time downhole data.

15. The method of claim 1, comprising pulling the drillstring out of the borehole after performing the directional drilling operation and acquiring data during the pulling of the drillstring out of the borehole, wherein one or more of the characteristics is adjusted to generate a set of the characteristics of the borehole, wherein the adjusting utilizes at least a portion of the acquired data.

16. The method of claim 15, comprising running the drillstring into the borehole after pulling the drillstring out of the borehole, acquiring data during the running of the drillstring into the borehole, and adjusting one or more of the characteristics to generate a revised set of the characteristics for the borehole.

17. The method of claim 1, comprising, wherein the selected drillstring drilling mode is the blind mode, inferring a state of the RSS tool using data acquired by a surface listener unit.

18. The method of claim 1, comprising detecting the operational issue based at least in part on one or more of receipt of data by a surface listener unit and a failure to receive data by the surface listener unit.

19. A system comprising:

one or more processors;

memory accessible to at least one of the one or more processors;

processor-executable instructions stored in the memory and executable to instruct the system to:

receive real-time downhole data, via mud-pulse telemetry, acquired by one or more sensors of one or more tools of a drillstring disposed in a borehole in a subsurface geologic region during a directional drilling operation, wherein a drill bit of the drillstring breaks rock of the subsurface geologic region to lengthen the borehole, wherein the one or more tools comprise a measurement while drilling (MWD) tool and a rotary steerable system (RSS) tool, and wherein the drillstring comprises a mud-pulse telemetry unit and MWD tool and RSS tool uplink circuitry;

identify that an insufficient portion of the real-time downhole data is insufficient for use in a hole bottom estimation based at least in part on an operational issue of the MWD tool and RSS tool uplink circuitry;

identify an operational issue between the MWD tool and the RSS tool uplink circuitry, wherein the identification of the operational issue triggers an implementation of a blind mode, wherein the blind mode modifies the real-time downhole data to generate modified real-time downhole data, and wherein the modified real-time downhole data excludes measurements from the RSS tool;

infer, using the modified real-time downhole data, an inferred state of the RSS tool;

based on the insufficient portion, implement a blind mode for a drilling mode model used to estimate a hole bottom position of a hole bottom, wherein, in the blind mode, the drilling mode model excludes measurements from the RSS tool and includes the inferred state of the RSS tool;

estimate a hole bottom position of a hole bottom using a drilling mode model, the inferred state of the RSS tool, and the modified real-time downhole data generated from the blind mode predict, in real-time, one or more characteristics of the hole bottom of the borehole using the drilling mode model in the blind mode and at least a portion of the modified real-time downhole data; and control the directional drilling operation using the blind mode for the drilling mode model and the one or more of the characteristics of the hole bottom of the borehole, wherein controlling the directional drilling operation includes adjusting an orientation of the drill bit from a first orientation to a second orientation.

20. One or more non-transitory computer-readable storage media comprising processor-executable instructions to instruct a computing system to:

receive real-time downhole data, via mud-pulse telemetry, acquired by one or more sensors of one or more tools of a drillstring disposed in a borehole in a subsurface geologic region during a directional drilling operation, wherein a drill bit of the drillstring breaks rock of the subsurface geologic region to lengthen the borehole, wherein the one or more tools comprise a measurement while drilling (MWD) tool and a rotary steerable system (RSS) tool, and wherein the drillstring comprises a mud-pulse telemetry unit and MWD tool and RSS tool uplink circuitry;

identify that an insufficient portion of the real-time downhole data is insufficient for use in a hole bottom estimation based at least in part on an operational issue of the MWD tool and the RSS tool uplink circuitry;

identify an operational issue between the MWD tool and the RSS tool uplink circuitry, wherein the identification of the operational issue triggers an implementation of a blind mode, wherein the blind mode modifies the real-time downhole data to generate modified real-time downhole data, and wherein the modified real-time downhole data excludes measurements from the RSS tool;

infer, using the modified real-time downhole data, an inferred state of the RSS tool;

based on the insufficient portion, implement a blind mode for a drilling mode model used to estimate a hole bottom position of a hole bottom, wherein, in the blind mode, the drilling mode model excludes measurements from the RSS tool and includes the inferred state of the RSS tool;

estimate a hole bottom position of a hole bottom using a drilling mode model, the inferred state of the RSS tool, and the modified real-time downhole data generated from the blind mode;

predict, in real-time, one or more characteristics of the hole bottom of the borehole using the drilling mode model in the blind mode and at least a portion of the modified real-time downhole data; and control the directional drilling operation using the blind mode for the drilling mode model and the one or more of the characteristics of the hole bottom of the borehole, wherein controlling the directional drilling operation includes adjusting an orientation of the drill bit from a first orientation to a second orientation.

* * * * *